US011420714B1

(12) United States Patent
Masi

(10) Patent No.: US 11,420,714 B1
(45) Date of Patent: Aug. 23, 2022

(54) PERSONAL FLOTATION DEVICE

(71) Applicant: Douglas J. Masi, Goodyear, AZ (US)

(72) Inventor: Douglas J. Masi, Goodyear, AZ (US)

(73) Assignee: D and M Asset Management, LLC, Goodyear, AZ (US)

( * ) Notice: Subject to any disclaimer, the term of this patent is extended or adjusted under 35 U.S.C. 154(b) by 124 days.

(21) Appl. No.: 17/080,338

(22) Filed: Oct. 26, 2020

Related U.S. Application Data

(63) Continuation-in-part of application No. 16/200,218, filed on Nov. 26, 2018, now Pat. No. 10,814,943, which is a continuation-in-part of application No. 15/728,866, filed on Oct. 10, 2017, now Pat. No. 10,219,633.

(60) Provisional application No. 62/409,527, filed on Oct. 18, 2016, provisional application No. 62/691,882, filed on Jun. 29, 2018.

(51) Int. Cl.
*B63B 34/50* (2020.01)
*A47G 23/02* (2006.01)

(52) U.S. Cl.
CPC ..... *B63B 34/50* (2020.02); *A47G 23/0216* (2013.01); *A47G 2200/02* (2013.01)

(58) Field of Classification Search
CPC .. B63B 34/50; A47G 23/0216; A47G 2200/02
See application file for complete search history.

(56) References Cited

U.S. PATENT DOCUMENTS 3,067,441 A * 12/1962 Dysard ..... B63B 34/50 441/132
3,117,327 A * 1/1964 Mathew ..... A47C 15/006 297/411.44
4,115,888 A * 9/1978 Sievers ..... B63B 34/50 440/38
D350,326 S * 9/1994 Grifflin ..... D21/803
5,403,220 A * 4/1995 Goad, Sr. ..... B63H 25/46 441/130
5,520,561 A * 5/1996 Langenohl ..... B63B 34/50 441/132
5,628,658 A * 5/1997 Clifford ..... B63B 34/50 441/130
6,224,444 B1 * 5/2001 Klimenko ..... A47C 15/006 441/130
6,227,925 B1 * 5/2001 Boddy ..... B63B 34/52 441/129
6,276,979 B1 * 8/2001 Saltel ..... B63B 34/50 441/132

(Continued)

*Primary Examiner* — S. Joseph Morano
*Assistant Examiner* — Jovon E Hayes
(74) *Attorney, Agent, or Firm* — Invention To Patent Services; Alex Hobson

(57) ABSTRACT

A personal flotation system provides a horseshoe shaped float that is buoyant and can be used in a number or positions to float a person on the water and retain a beverage. The horseshoe shaped flotation device has a left and right armrest that extend out from an arced shaped closed end and dual cup holder, on the extended end of the armrest, has an cup cylinder to retain a beverage in the vertical orientation and an end cup holder to retain a beverage in an orthogonal orientation to the cup cylinder. The flotation device may have an extending strap that couples the left and right armrests together to secure the horseshoe shaped float around a person's torso.

20 Claims, 20 Drawing Sheets

(56) References Cited

U.S. PATENT DOCUMENTS

| | | | | |
|---|---|---|---|---|
| 6,746,293 | B1 * | 6/2004 | Kirby, Jr | A47C 15/006 4/492 |
| D549,297 | S * | 8/2007 | Eagan | D21/803 |
| 7,571,965 | B1 * | 8/2009 | Perry | A47C 15/006 297/440.16 |
| 7,587,986 | B2 * | 9/2009 | Neidert | B63B 34/50 114/61.15 |
| 75,877,986 | | 9/2009 | Neidert | |
| 9,598,153 | B2 * | 3/2017 | Connolly | A63B 21/0084 |
| 10,219,633 | B1 * | 3/2019 | Masi | B65D 85/70 |
| 2010/0032995 | A1 * | 2/2010 | Tarter | F21V 33/008 297/188.01 |

* cited by examiner

PERSONAL FLOTATION DEVICE

CROSS REFERENCE TO RELATED APPLICATIONS

This application is a continuation in part of U.S. patent application Ser. No. 16/200,218, filed Nov. 26, 2018 and currently pending, which is a continuation in part of Ser. No. 15/728,866, filed on Oct. 10, 2017 and now issued as U.S. patent Ser. No. 10/219,633 on Mar. 5, 2019 and entitled Personal Flotation Device, which claims the benefit of U.S. provisional patent application 62/409,527 filed on Oct. 18, 2016, and U.S. application Ser. No. 16/200,218 claims the benefit of priority to U.S. provisional patent application No. 62/691,882, filed on Jun. 29, 2018; the entirety of each is hereby incorporated by reference herein.

BACKGROUND OF THE INVENTION

Field of the Invention

The present invention relates to the field of transporting and ships including equipment for life-saving in water, more specifically, an adaptation of vessel parts of furnishing for lifesaving purposes for use with people and animals.

Background

Personal flotation devices (PFDs) typically have a fixed shape which limits the ways in which they can be used. There exits a need for a personal flotation device that can be used in a variety of configurations, that is flexible and has retainers for beverages.

SUMMARY OF THE INVENTION

The personal flotation device is adapted for use with a person. The personal flotation device is adapted for use with a pet. The personal flotation device (PFD) is configured for use with water. The personal flotation device is a device that provides buoyancy during water based activities. An exemplary personal flotation device is a multipurpose device that: 1) forms a seat for use such as in a small water craft; 2) forms a raft for use in the water; and, 3) forms a plurality of flotation devices. An exemplary personal flotation system is suitable for providing flotation for a person, child, object and the like. An exemplary personal flotation system comprises a pet pad, a float, an insulated storage case, a dry storage container, and a plurality of straps. A plurality of straps may detachably attach the pet pad, the float, the insulated storage case, and the dry storage container to form the seat and the raft portions of the personal flotation device.

These together with additional objects, features and advantages of the personal flotation device will be readily apparent to those of ordinary skill in the art upon reading the following detailed description of the presently preferred, but nonetheless illustrative, embodiments when taken in conjunction with the accompanying drawings.

A personal flotation device may be configured with a pet pad attached to the horseshoe shaped float and may form a seat that can be used on the water, on land or on another watercraft, such as a wake board, a standing paddle board, boat and the like.

In this respect, before explaining the current embodiments of the personal flotation device in detail, it is to be understood that the personal flotation device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personal flotation device.

It is therefore important that the claims be regarded as including such equivalent construction insofar as they do not depart from the spirit and scope of the personal flotation device. It is also to be understood that the phraseology and terminology employed herein are for purposes of description and should not be regarded as limiting.

An exemplary horseshoe shaped personal flotation device can be used in a number of ways to support or float a person on the water. A person may wrap the opening of the horseshoe shaped personal flotation device around their waist or torso, and extend their arms over the left and right armrest to float in the water. A beverage may be retained in the left or right cup holder while floating in the under-arm flotation configuration. A user may use the flotation device in saddle float configuration, wherein the flotation device is configured with the closed end between their legs and under their crotch and with the one of the left and right armrests extending up in front of them and the other extending up along their back. In the saddle float orientation, a beverage may be retained in the end cup holder of the armrest extending up in front of the person. A person may use the personal flotation device in a hammock float configuration similar to the saddle-float configuration except that they lay back to extend the left armrest away from the right armrest. The armrest extending along their back opens up with respect to the closed end, wherein the length axis of the armrest is open from a parallel orientation with the other armrest to an angle of about 50 degrees or more, about 60 degrees or more, about 80 degrees more, about 100 degrees or more or about 120 degrees or more or from about 50 degrees to 140 degrees. A person may use the personal flotation device in a back-float configuration similar to the hammock float configuration except that they are in a supine orientation, with the flotation device further extended into an open configuration wherein the length axis of the left and right armrest extend at an angle of about 100 degrees or more, about 120 degrees or more, about 140 degrees more, about 160 degree or from about 100 degrees to about 180 degrees.

An exemplary personal flotation device is made from an elastomeric material, or a material that can be deformed by a load and then substantially return to an original shape after removal of the load. The exemplary personal flotation device may be deformed by opening the left and/or right armrest to enlarge the opening therebetween, and then return substantially to the original horseshoe shape. An exemplary personal flotation device, pet pad and/or dry storage case may be relatively soft, having a shore A value of about 10 to 60, with a preferred range of between about 10 to 35, or no more than about 50. An exemplary personal flotation, device, pet pad and/or dry storage case are buoyant and float on water and may be a foam, such as a closed cell foam or may include a bladder that has an internal volume of air or lightweight material, such as a foam. In an exemplary embodiment, a bladder is an inflatable bladder that can be filled through a fill port, such as a nozzle that can be filled by blowing into the nozzle. An exemplary foam is a water-resistant foam and may be made out of a plastic or polymeric material, such as Ethylene-Vinyl Acetate (EVA), urethane, low density polyethylene (LDPE), polyimide, polypropylene, polyvinyl chloride, silicone and the like. An exemplary personal flotation device, pet pad and/or dry storage case may comprise a cover layer that extends over the foam and is water impermeable. This cover layer may prevent water from entering into the cells of foam and reducing buoyance. A cover layer may be a skin of the polymer used to make the foam and may be formed in-situ during the molding process of the flotation device.

An exemplary personal flotation device may have a PFD strap system comprising a PFD retaining strap that has an extending strap that is couped to one side or armrest of the horseshoe shaped floatation device and is configured to detachably attach or couple with the opposing armrest. An extending strap may have hook-and-loop fastener that is configured to detachably attach with hook-and-loop fastener on the opposing side or armrest, for example. An exemplary PFD strap system may comprise a left PFT extending strap and a right PFD extending strap, each having a buckle to secure the horseshoe shaped float about a person. The strap can be buckled and tightened by pulling on the strap of one or both of the PFD buckles to synch the extended ends of the left armrest and right armrest tight about a person's torso. The PFD retaining strap is secured to the horseshoe shaped float by over-straps, or straps that extend over and around the horeshoe shaped float, such as around the left and/or right armrest or around the closed end, such as on either side of the neck extension. A person can be securely supported in the water with the PFD retaining strap buckled and pulled tight to secure the horseshoe shaped float about a person's torso. Note that a buckle may be on only one of the extending straps and may this buckle may be configured to couple with a buckle on the opposing armrest, such as to a buckle coupled to one of the over-straps, for example.

An exemplary PFD extending strap, may be referred to herein as simply an extending strap.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
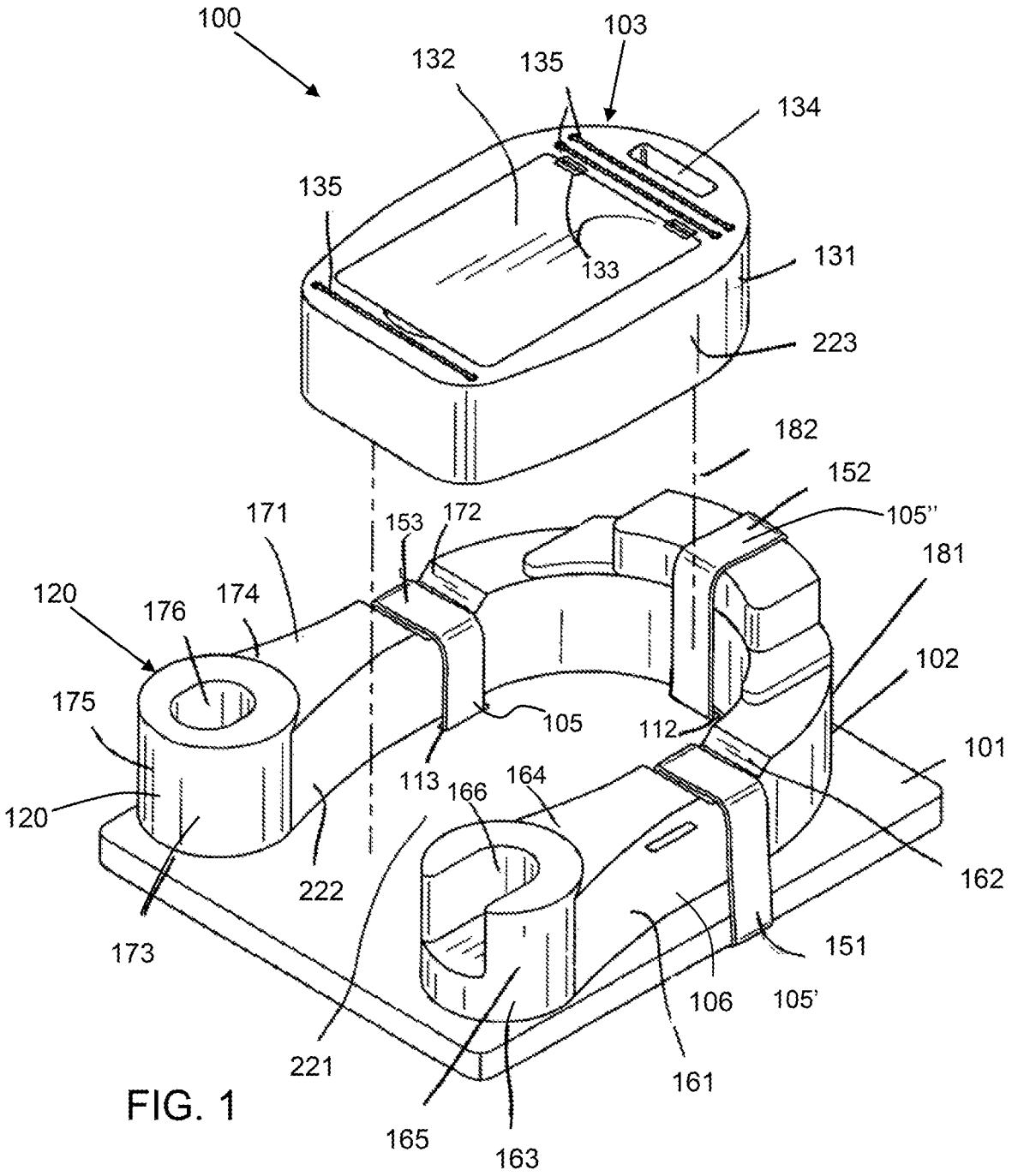
FIG. 1 is a perspective view of an embodiment of the disclosure.
Figure 2:
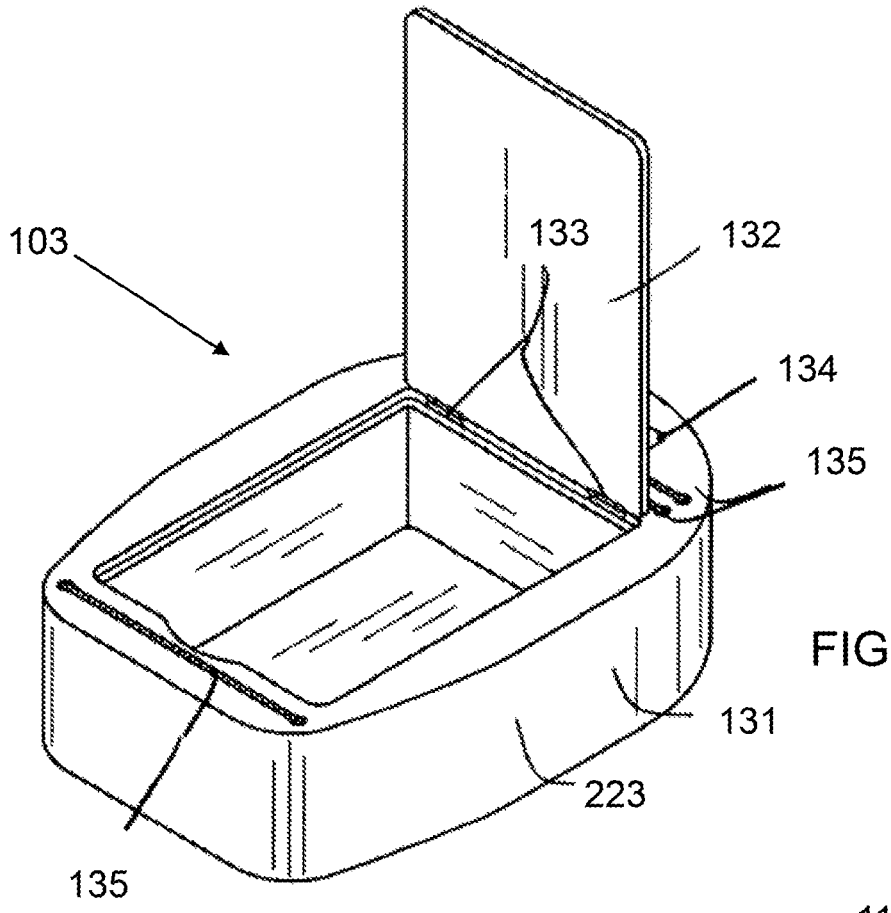
FIG. 2 is a perspective view of an embodiment of the disclosure.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

A personal flotation system includes a personal flotation device (PFD) that is adapted for use with a person to provide buoyance for a person in the water and may keep a person afloat in the water. The personal flotation system may be adapted for use with a pet. The PFD is configured for use with water. The PFD is a device that provides buoyancy during water based activities. The personal flotation system may be a multipurpose system that: 1) forms a seat for use in a small water craft; 2) forms a raft for use in the water; and, 3) forms a plurality of flotation devices. The personal flotation system may include a pet pad, a float, or horseshoe shaped float, an insulated storage case, a dry storage case, and a plurality of straps. The plurality of straps may be configured to interconnect the pet pad, the float, the insulated storage case, and the dry storage case to form the seat and the raft portions. A person may use the float as a PFD in an emergency situation. A pet may use the pet pad as a PFD in an emergency situation The person 201 refers to an individual who is using the PFD as intended. The pet 202 refers to a domesticated animal that is accompanying the person 201 in the small water 204 craft 203 and the water 204. The small water 204 craft 203 refers to a small vehicle adapted for use in travel over water 204. The water 204 refers to the body of water 204 on which the personal flotation system is being used. The beverage 205 refers to a can, cup or bottle of a consumable liquid.

Figure 6:
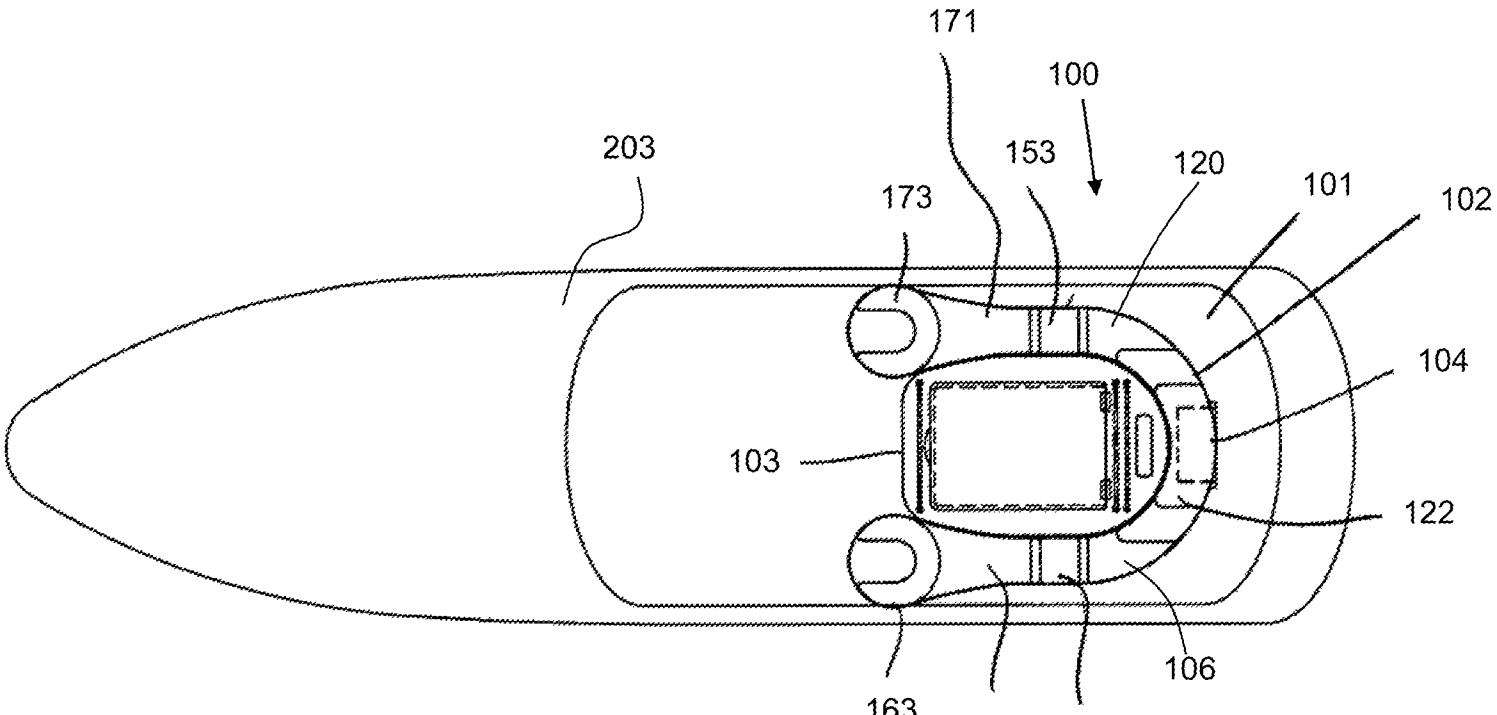
FIG. 6 is an in use view of an embodiment of the disclosure.
Figure 7:
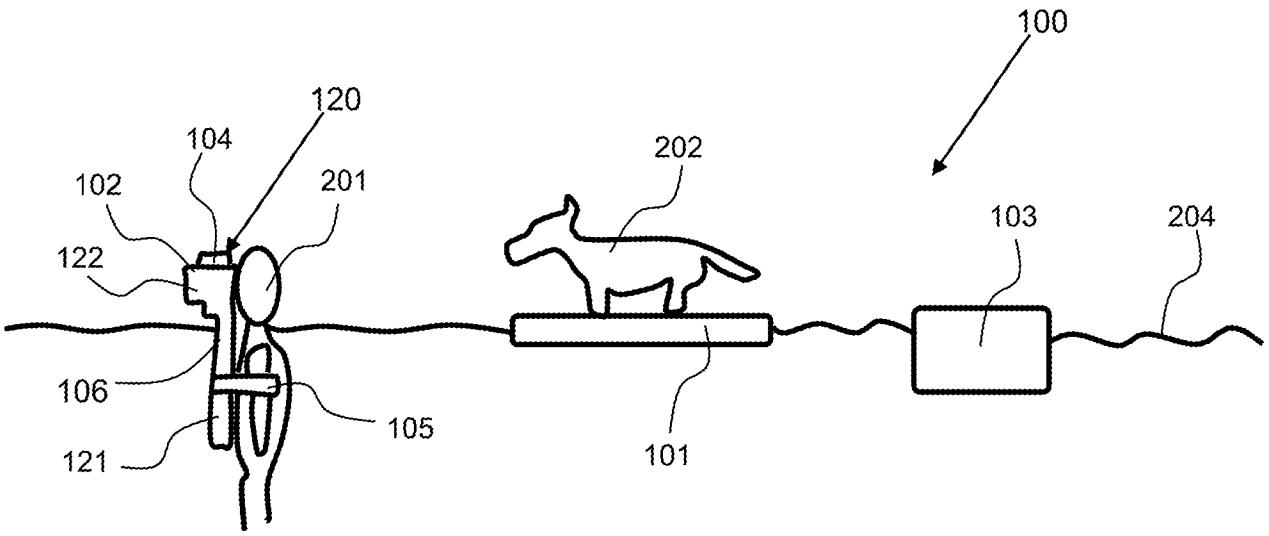
FIG. 7 is an in use view of an embodiment of the disclosure.
Figure 8:
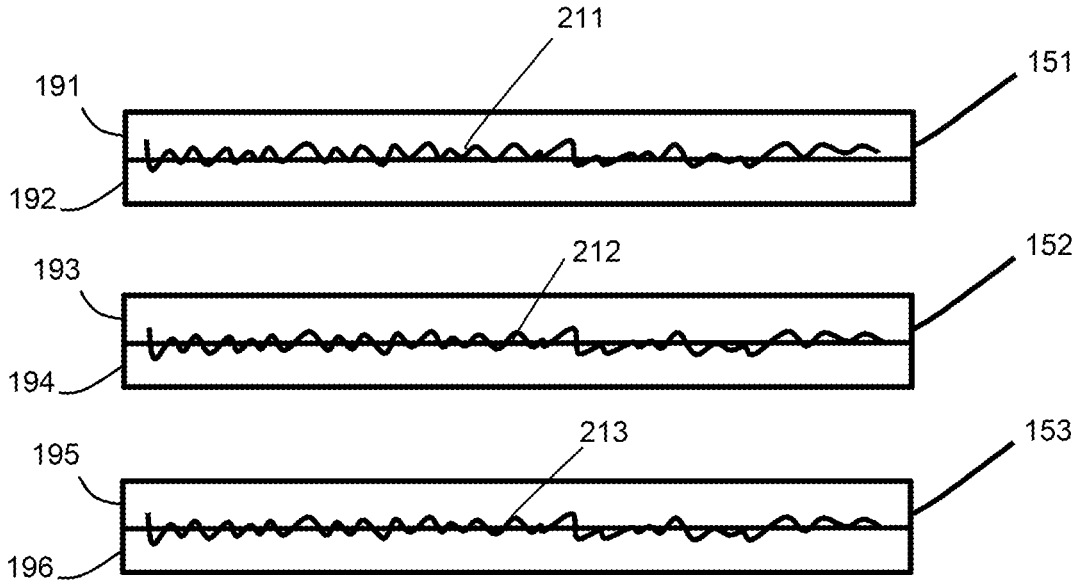
FIG. 8 is a view of an embodiment of the disclosure.

The exemplary pet pad 101 is a rectangular plate, or panel, molded from a foam, such as a closed cell ethylene-vinyl acetate (EVA) foam. The EVA foam used in the pet pad 101 provides the buoyancy of the pet pad 101. When the personal flotation system 100 is used as a raft, as shown most clearly in FIG. 9, the pet pad 101 forms a buoyant horizontal surface that forms a seat that keeps the person 201 afloat in the water 204. When the personal flotation system 100 is used as a PFD as shown most clearly in FIG. 7, the pet pad 101 forms a buoyant horizontal surface that keeps the pet 202 afloat in the water 204. When the personal flotation system 100 is used as a seat as shown most clearly in FIGS. 1 and 6, the pet pad 101 forms a pedestal that supports the float 102 and the insulated storage case 103 on the small water 204 craft 203.

The exemplary pet pad 101 comprises a buoyant plate 110. The buoyant plate 110 further comprises a first slot 111, a second slot 112, and a third slot 113.

The exemplary buoyant plate 110 is a rectangular plate formed from EVA foam. The buoyant plate 110 provides the buoyancy of the pet pad 101. The first slot 111 is an aperture formed through the buoyant plate 110. The first slot 111 is sized such that a strap selected from the plurality of straps 105 can be inserted through the first slot 111. The second slot 112 is an aperture formed through the buoyant plate 110. The second slot 112 is sized such that a strap selected from the plurality of straps 105 can be inserted through the second slot 112. The third slot 113 is an aperture formed through the buoyant plate 110. The third slot 113 is sized such that a strap selected from the plurality of straps 105 can be inserted through the third slot 113.

The exemplary float 102 and the insulated storage case 103 are mounted on the pet pad 101 when the personal flotation system 100 is used as the seat. The float 102 is a horseshoe shaped structure formed from EVA foam. The EVA foam used in the float 102 provides the buoyancy of the float 102.

Figure 9:
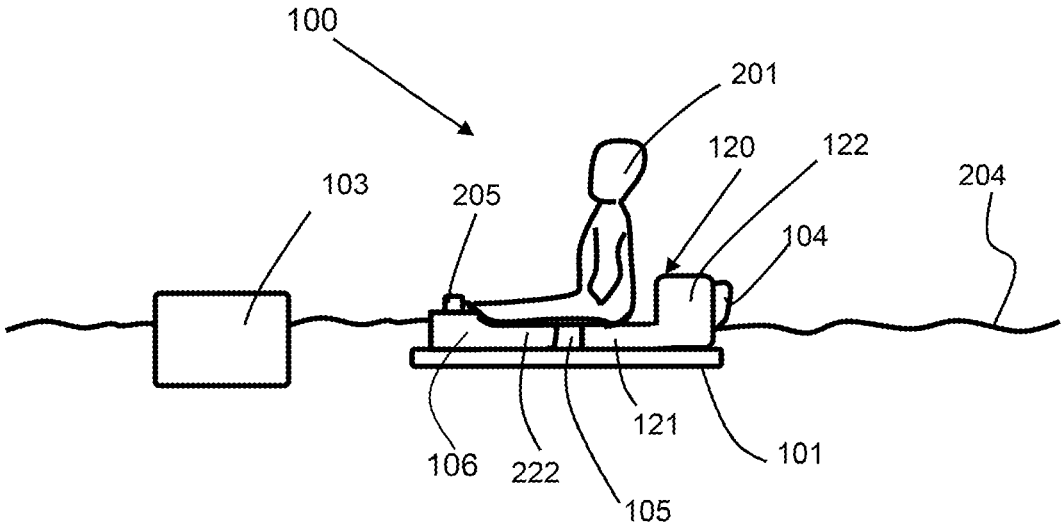
FIG. 9 is an in use view of an embodiment of the disclosure.

When the exemplary personal flotation system 100 is used as a raft, as shown most clearly in FIG. 9, the float 102 forms a buoyant structure 121 that further keeps the person 201 afloat in the water 204. In this scenario, the float 102 further forms a left armrest 161 and a right armrest 171 for use by the person 201. When the personal flotation system 100 is used as a PFD as shown most clearly in FIG. 7, the float 102 forms a buoyant structure 121 that is worn by the person 201 and that keeps the person 201 afloat in the water 204. When the personal flotation system 100 is used as a seat as shown most clearly in FIGS. 1 and 6, the float 102 forms a backrest, a left armrest 161, and a right armrest 171 for use by the person 201.

The exemplary personal flotation device 120, or float 102 comprises a buoyant structure 121 and a bias mass 122. The buoyant structure 121 is further defined with a flush or planar bottom surface 224, a structured surface 225, upper or top surface, a negative space 221, and an inner perimeter 222. The negative space 221 refers to the area partially bounded by the inner perimeter 222 of the float 102. The inner perimeter 222 refers to the concave surfaces of the float 102 formed by the left armrest 161, the right armrest 171, and the right armrest 171. The flush surface 224 is the surface of the float 102 that is proximal to the pet pad 101 when the personal flotation system 100 is used as a raft and a seat. The flush surface 224 forms a planar surface such that the flush surface 224 sits flush against the pet pad 101. The structured surface 225 is the surface of the float 102 that is distal from the flush surface 224.

The exemplary buoyant structure 121 is a horseshoe shaped structure formed from a buoyant material, such as an EVA foam. The buoyant structure 121 forms the characteristic horseshoe shape of the float 102. The buoyant structure 121 comprises a left armrest 161, a right armrest 171, and a closed end 181. The left armrest 161 is further defined with a left arm free end 164. The right armrest 171 is further defined with a right arm free end 174. The closed end 181 is further defined with a closed end midpoint 182.

The exemplary left armrest 161 comprises a left arm groove 162 and a left arm cup holder 163. The left arm cup holder 163 further comprises a left arm bulb 165 and a left arm cup cylinder 166. The right armrest 171 comprises a right arm groove 172 and a right arm cup holder 173. The right arm cup holder 173 further comprises a right arm bulb 175 and a right arm cup cylinder 176.

The exemplary left armrest 161 is the arm of the horseshoe shaped float 106 of the float 102 that is proximal to the left side of the person 201, or extends from the right side of the closed end when viewed from the extended ends of the left and right armrests. The left arm groove 162 is a groove formed in the structured surface 225 of the left armrest 161. The left groove 162 receives the first hook-and-loop fastener 151 that the first hook-and-loop fastener 151 will not shift use. The left arm cup holder 163 is a structure that is arm such during formed at the left arm free end 164. The left arm cup holder 163 provides a location to store a beverage 205 during water 204 based activities. The left arm free end 164 is the end of the left armrest 161 that is distal from the closed end 181.

The exemplary left arm bulb 165 is a roughly cylindrical structure that attaches to the left arm free end 164 of the left armrest 161. The left arm cup cylinder 166 is a negative space that is formed as a cylinder. The left arm cup cylinder 166 is coaxially located within the left arm bulb 165. The opening to the left arm cup cylinder 166 is formed in the structured surface 225 of the left armrest 161. The left arm cup cylinder 166 is sized to receive the beverage 205.

The exemplary right armrest 171 is the arm of the horseshoe shape of the float 102 that is proximal to the right side of the person 201. The right arm groove 172 is a groove formed in the structured surface 225 of the right armrest 171. The right arm groove 172 receives the third hook-and-loop fastener 153 such that the third hook-and-loop fastener 153 will not shift during use. The right arm cup holder 173 is a structure that is formed at the right arm free end 174. The right arm cup holder 173 provides a location to store a beverage 205 during water 204 based activities. The right arm free end 174 is the end of the right armrest 171 that is distal from the closed end 181.

The exemplary right arm bulb 175 is a roughly cylindrical structure that attaches to the right arm free end 174 of the right armrest 171. The right arm cup cylinder 176 is a negative space that is formed as a cylinder. The right arm cup cylinder 176 is coaxially located within the right arm bulb 175. The opening to the right arm cup cylinder 176 is formed in the structured surface 225 of the right armrest 171. The right arm cup cylinder 176 is sized to receive the beverage 205.

The exemplary bias mass 122 is an additional structure formed from EVA foam. The bias mass 122 attaches to the structured surface 225 of the buoyant structure 121 at the closed end midpoint 182 of the closed end 181. The bias mass 122 creates an asymmetry in the buoyancy of the float 102. When the personal flotation system 100 is worn as a PFD the asymmetry formed by the bias mass 122 ensures that the head of the person 201 remains above the water 204.

The exemplary insulated storage case 103 is an insulating structure suitable for storing foodstuffs and beverages 205. The insulated storage case 103 is a hollow structure formed in a roughly rounded rectilinear block shape. The insulated storage case 103 is formed from EVA foam. The EVA foam used in the insulated storage case 103 provides the insulated storage case 103 with enough buoyancy that the insulated storage case 103 can keep itself and the contents contained within the insulated storage case 103 afloat. The form factor of the insulated storage case 103 is congruent to the form factor of the hollow interior of the float 102 such that the insulated storage case 103 will fit flush within the hollow center of the float 102. In this configuration the insulated storage case 103 and the float 102 will effectively form a single structure.

When the personal flotation system 100 is used as a raft, as shown most clearly in FIG. 9, the insulated storage case 103 floats beside the person 201 in the water 204. When the personal flotation system 100 is used as a PFD as shown most clearly in FIG. 7, the insulated storage case 103 floats beside the person 201 in the water 204. When the personal flotation system 100 is used as a seat as shown most clearly in FIGS. 1 and 6, the insulated storage case 103 forms the bench upon which the person 201 sits while in the small water 204 craft 203.

The exemplary insulated storage case 103 comprises a container 131, a lid 132, a hinge 133, a handle slot 134, and a plurality of bungee cords 135. The container 131 is further defined with an outer perimeter 223. The outer perimeter 223 refers to the exterior surfaces of the container 131 of the insulated storage case 103 that are congruent to the inner perimeter 222 of the float 102.

The exemplary container 131 is a hollow insulating structure formed from EVA foam. The form factor of the container 131 is congruent to the form factor of the hollow interior of the buoyant structure 121. The container 131 receives the foodstuffs, the beverages 205, and other contents stored in the container 131 through the open face. The EVA foam used in the container 131 ensures that the insulated storage case 103 and the contents of the insulated storage case 103 remain afloat while in the water 204.

The exemplary lid 132 is a cover that is attached to the container 131 such that the lid 132 rotates relative to the open face of the container 131. The lid 132 is a barrier that covers the open face of the container 131. The lid 132 controls access into the hollow interior of the container 131.

The exemplary hinge 133 refers to commercially available hardware that attaches the lid 132 to the container 131 such that the lid 132 rotates in a manner that opens and closes the open face of the container 131. The handle slot 134 is an aperture that forms a channel in a wall of the container 131. The handle slot 134: 1) forms a grip used by the person 201; and 2) forms an anchor point that allows the second hook-and-loop fastener 152 to attach the insulated storage case 103 to the float 102. Each of the plurality of bungee cords 135 attaches to the exterior surface of the container 131. Each of the plurality of bungee cords 135 is an elastic cord used to attach objects to the exterior surface of the container 131.

The exemplary dry storage case 104 is a water 204 tight containment structure. The dry storage case 104 contains items that the person 201 wants to keep dry while on the water 204. When the personal flotation system 100 is used as a raft, as shown most clearly in FIG. 9, the dry storage case 104 attaches to the float 102. When the personal flotation system 100 is used as a PFD as shown most clearly in FIG. 7, the dry storage case 104 attaches to the float 102. When the personal flotation system 100 is used as a seat as shown most clearly in FIGS. 1 and 6, the dry storage case 104 attaches to the float 102.

The exemplary dry storage case 104 comprises a dry bag 141 and a fourth hook-and-loop fastener 154. The fourth hook-and-loop fastener 154 further comprises a seventh hook/loop surface 197 and an eighth hook/loop surface 198. The dry bag 141 is a commercially available bag that is designed to contain objects in a water 204 impermeable environment. The dry bag 141 attaches to the float 102 using the fourth hook-and-loop fastener 154. The seventh hook/loop surface 197 of the fourth hook-and-loop fastener 154 attaches to the back of the closed end 181 of the float 102 at the closed end midpoint 182. The eighth hook/loop surface 198 attaches to the dry bag 141. The dry bag 141 attaches to the float 102 by pressing the seventh hook/loop surface 197 to the eighth hook/loop surface 198 to form the fourth hook-and-loop fastener 154.

Each of the plurality of straps 105 is a commercially available fastening device. When the personal flotation system 100 is used as a raft, as shown most clearly in FIG. 9, the plurality of straps 105 binds the float 102 to the pet pad 101. When the personal flotation system 100 is used as a PFD as shown most clearly in FIG. 7, the plurality of straps 105 binds the float 102 to the person 201. When the personal flotation system 100 is used as a seat as shown most clearly in FIGS. 1 and 6, the plurality of straps 105 binds the float 102 and the insulated storage case 103 to the pet pad 101.

The plurality of straps 105 comprises a first hook-and-loop fastener 151, a second hook-and-loop fastener 152, and a third hook-and-loop fastener 153. The first hook-and-loop fastener 151 further comprises a first hook/loop surface 191, a second hook/loop surface 192, and a first seam 211. The second hook-and-loop fastener 152 further comprises a third hook/loop surface 193, a fourth hook/loop surface 194, and a second seam 212. The third hook-and-loop fastener 153 further comprises a fifth hook/loop surface 195, a sixth hook/loop surface 196, and a third seam 213.

The first hook-and-loop fastener 151 is a strap configured as a hook-and-loop fastener. The first hook-and-loop fastener 151 is formed by attaching the first hook/loop surface 191 to the second hook/loop surface 192 using the first seam 211. The first hook/loop surface 191 and the second hook/loop surface 192 are joined back to back such that the first hook-and-loop fastener 151 will form a loop when the first hook/loop surface 191 is pressed against the second hook/loop surface 192.

The second hook-and-loop fastener 152 is a strap configured as a hook-and-loop fastener. The second hook-and-loop fastener 152 is formed by attaching the third hook/loop surface 193 to the fourth hook/loop surface 194 using the second seam 212. The third hook/loop surface 193 and the fourth hook/loop surface 194 are joined back to back such that the second hook-and-loop fastener 152 will form a loop when the third hook/loop surface 193 is pressed against the fourth hook/loop surface 194.

The third hook-and-loop fastener 153 is a strap configured as a hook-and-loop fastener. The third hook-and-loop fastener 153 is formed by attaching the fifth hook/loop surface 195 to the sixth hook/loop surface 196 using the third seam 213. The fifth hook/loop surface 195 and the sixth hook/loop surface 196 are joined back to back such that the third hook-and-loop fastener 153 will form a loop when the fifth hook/loop surface 195 is pressed against the sixth hook/loop surface 196.

The first seam 211 is a sewn seam. The second seam 212 is a sewn seam. The third seam 213 is a sewn seam. Sewn seams are discussed in greater detail elsewhere in this disclosure.

The first hook-and-loop fastener 151 attaches the left armrest 161 of the float 102 to the pet pad 101 during use of the personal flotation system 100 as a raft or a seat. The first hook-and-loop fastener 151 is placed over the left arm groove 162 of the left armrest 161, threaded through the first slot 111 and looped around the edge of the buoyant plate 110. The first hook-and-loop fastener 151 is secured by pressing the first hook/loop surface 191 against the second hook/loop surface 192. The first hook-and-loop fastener 151 binds the left armrest 161 to the left arm of the person 201 when the personal flotation system 100 is used as a PFD. The first hook-and-loop fastener 151 is secured by pressing the first hook/loop surface 191 against the second hook/loop surface 192.

The third hook-and-loop fastener 153 attaches the right armrest 171 of the float 102 to the pet pad 101 during use of the personal flotation system 100 as a raft or a seat. The third hook-and-loop fastener 153 is placed over the right arm groove 172 of the right armrest 171, threaded through the third slot 113 and looped around the edge of the buoyant plate 110. The third hook-and-loop fastener 153 is secured by pressing the fifth hook/loop surface 195 against the sixth hook/loop surface 196. The third hook-and-loop fastener 153 binds the right armrest 171 to the right arm of the person 201 when the personal flotation system 100 is used as a PFD. The third hook-and-loop fastener 153 is secured by pressing the fifth hook/loop surface 195 against the sixth hook/loop surface 196.

The second hook-and-loop fastener 152 attaches the closed end 181 of the float 102 to the pet pad 101 during use of the personal flotation system 100 as a raft or a seat. The second hook-and-loop fastener 152 further attaches the container 131 of the insulated storage case 103 to the pet pad 101 during use of the personal flotation system 100 as a raft or a seat. The second hook-and-loop fastener 152 is placed over the closed end 181 of the float 102. The second hook-and-loop fastener 152 is threaded through the handle slot 134 of the insulated storage case 103. The second hook-and-loop fastener 152 is threaded through the second slot 112 and looped around the edge of the buoyant plate 110. The second hook-and-loop fastener 152 is secured by pressing the third hook/loop surface 193 against the fourth hook/loop surface 194.

As shown in FIG. 9, a person 201 is floating on the personal flotation device 120 and is sitting on the pet pad 101 that is retained to the buoyant structure 121, the horseshoe shaped float, by straps 105. An insulated storage case 103 may be tethered to the personal flotation device and carry beverages.

Figure 10:
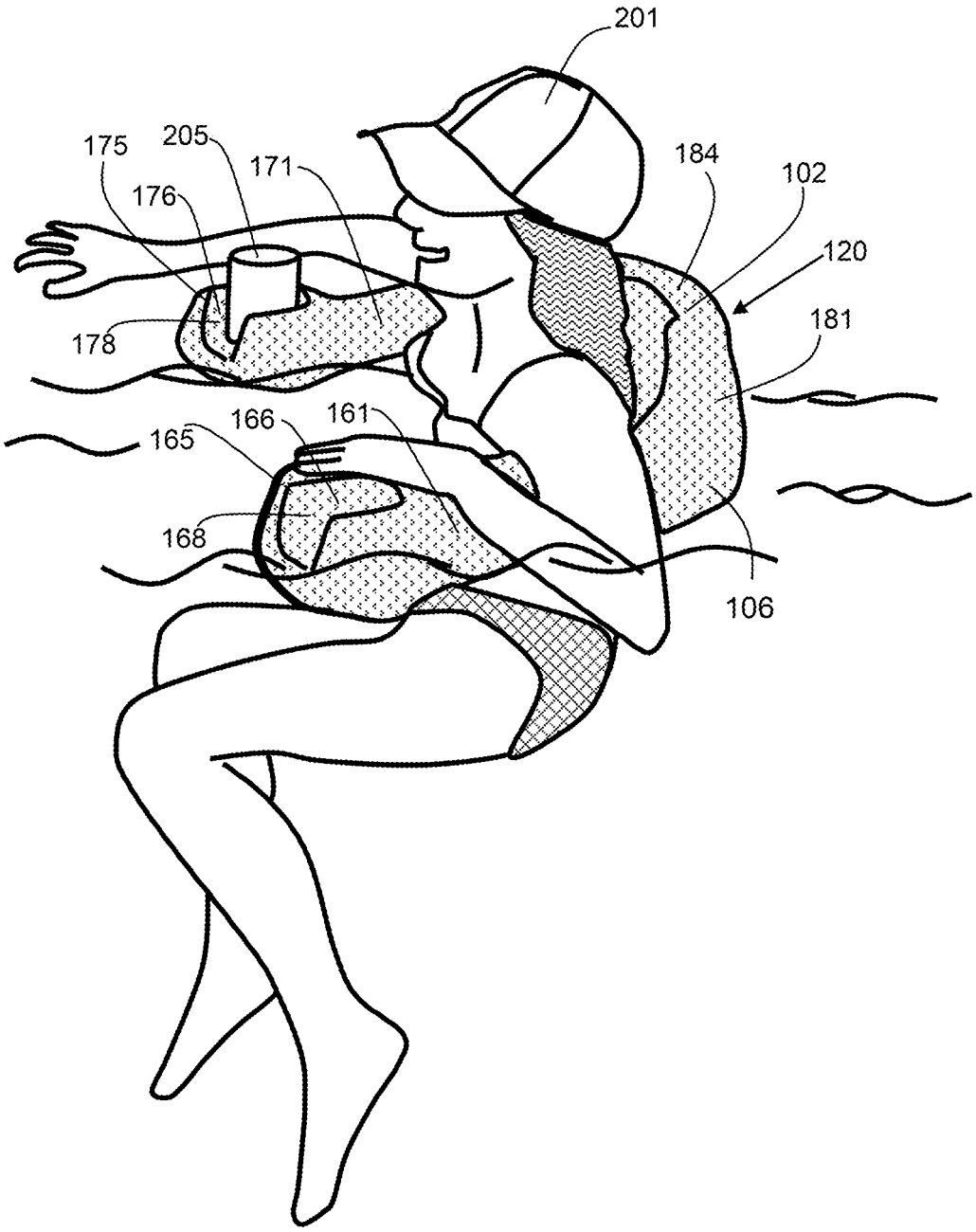
FIG. 10 shows an exemplary personal flotation device in use with a person floating in an underarm-floating configuration.

As shown in FIG. 10, an exemplary personal flotation device 120 is in use with a person 201 floating in an underarm-floating configuration. The person is floating in the horseshoe shaped flotation device and has the left armrest 161 and right armrest 171 configured under their left and right arms, respectively, and their torso is configured within the opening or space between the two armrests. The person's back is resting against the closed end 181 and their head can lean back against the neck extension 184. A beverage 205 is configured in the right cup cylinder 176. Note that the person could turn around with their chest against the closed end and place their chin on the neck extension 184. The right armrest 171 extends to right armrest free end having a cylindrically shaped right arm bulb 175 configured with a right arm cup cylinder 176 and a right arm end cup holder 178. The left armrest 161 extends to left armrest free end having a cylindrically shaped left arm bulb 165 configured with a left arm cup cylinder 166 and a left arm end cup holder 168.

Figure 11:
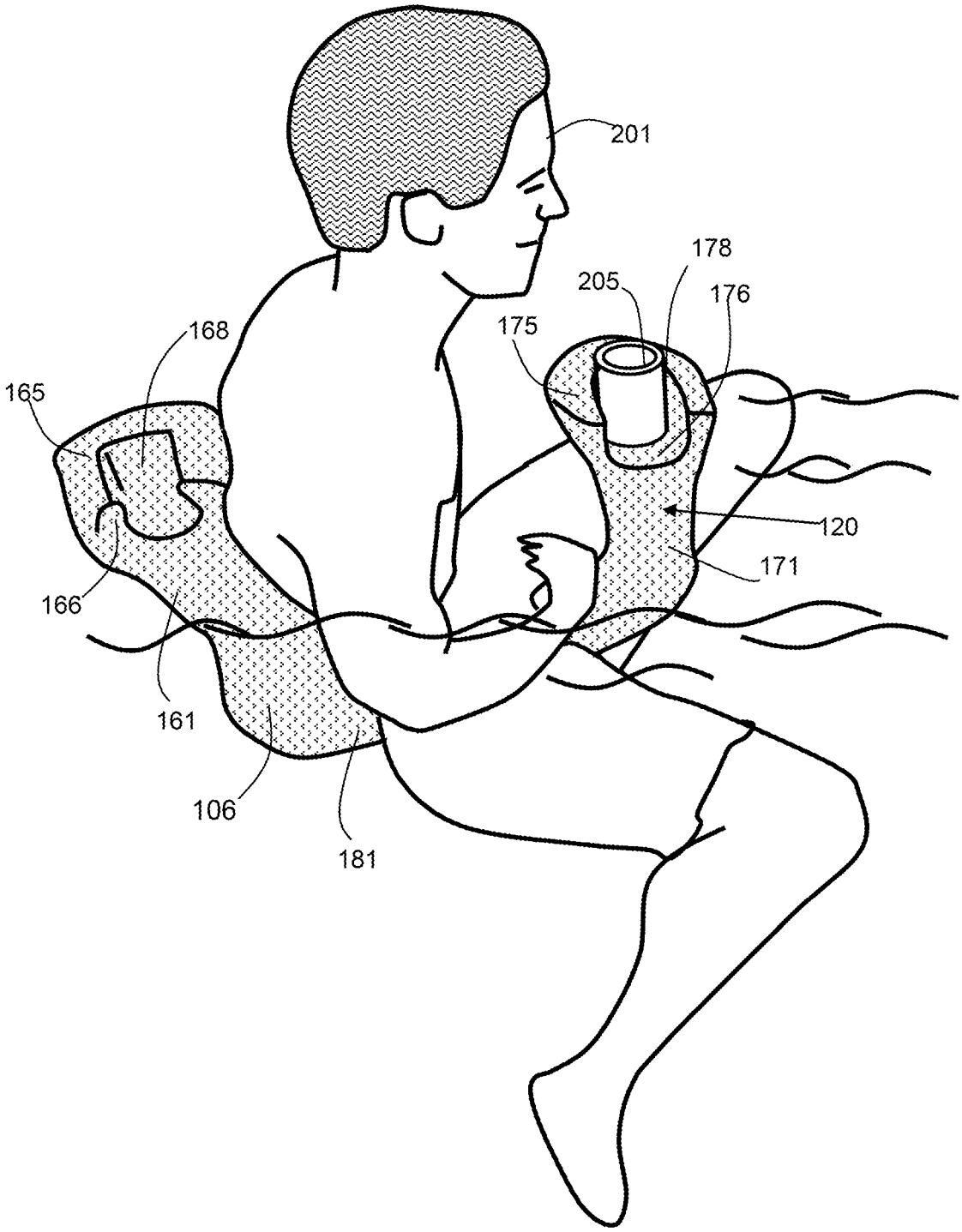
FIG. 11 shows an exemplary personal flotation device in use with a person floating in a saddle-floating configuration.

As shown in FIG. 11, an exemplary personal flotation device 120 is in use with a person 201 floating in a saddle-floating configuration. The closed end 181 is configured between the person's legs and extends through their crotch. The left armrest 161 extends from the crotch up along the person's back and the right armrest 171 extends from the crotch in front of the person. A beverage 205 is configured in the right end cup holder 178 of the right arm bulb 175.

Figure 12:
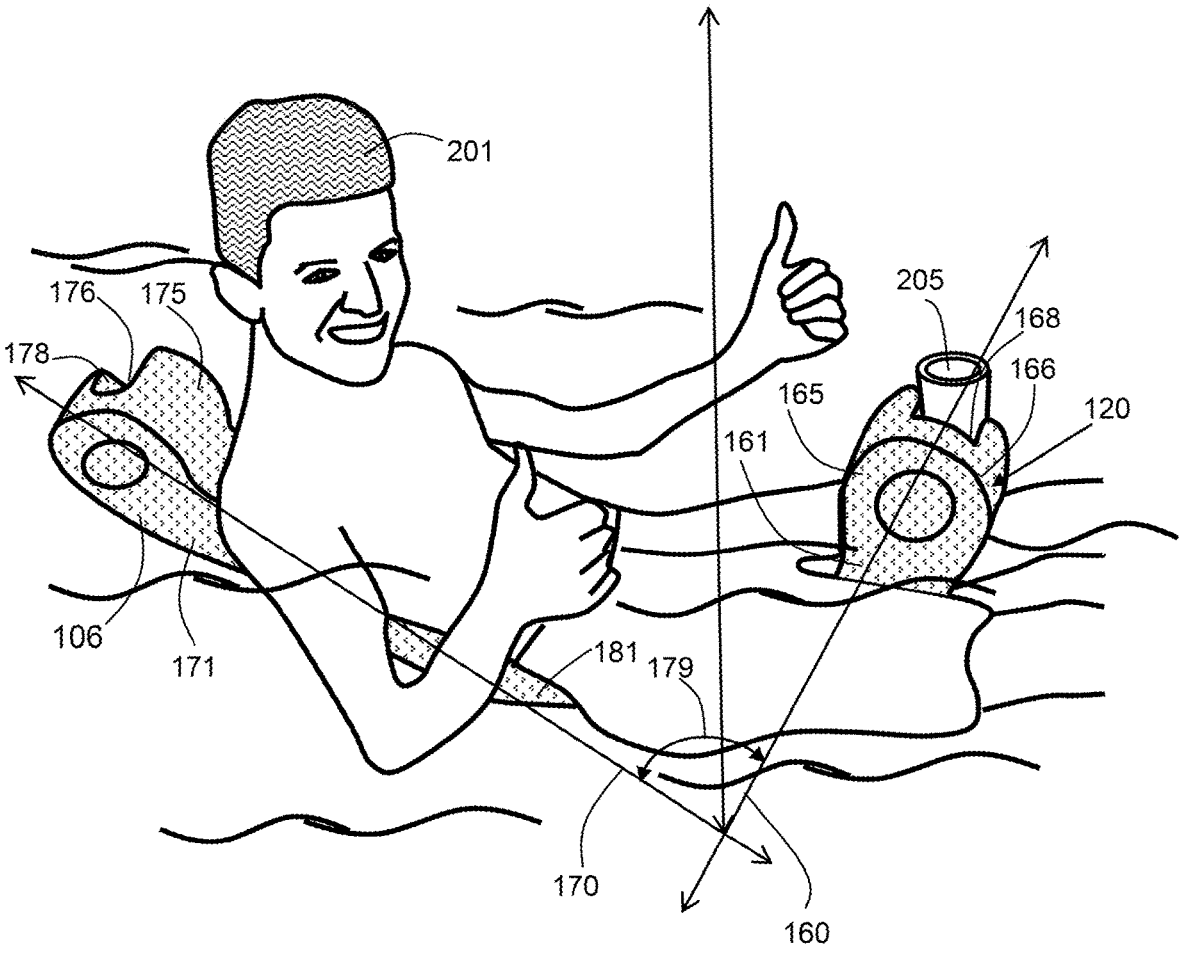
FIG. 12 shows an exemplary personal flotation device in use with a person floating in a hammock-floating configuration.

As shown in FIG. 12, an exemplary personal flotation device 120 is in use with a person 201 floating in a hammock-floating configuration. The hammock-floating configuration is similar to the saddle-floating configuration except that the person is more reclined, and the personal flotation device is extended or opened up to expand the distance between the left and right arm bulbs. The closed end 181 is more elongated or opened up and the inclusive angle 179 between the right arm length axis 170 and the left arm length axis 160 is about 60 degrees or more or about 80 degrees or more, about 90 degrees or more, about 110 degrees or more and any range between and including the inclusive angles provided. Put another way, the right armrest length axis 170 extends at an offset from vertical, such as at least 20 degrees from vertical, to as much as 60 degrees from vertical or 30 degrees from horizontal. The personal flotation device is configured between the person's legs and extends through the crotch. The right armrest 171 extends from the crotch up along the person's back and the left armrest 161 extends from the crotch in front of the person. A beverage 205 is configured in the left end cup holder 168 of the left arm bulb 165.

Figure 13:
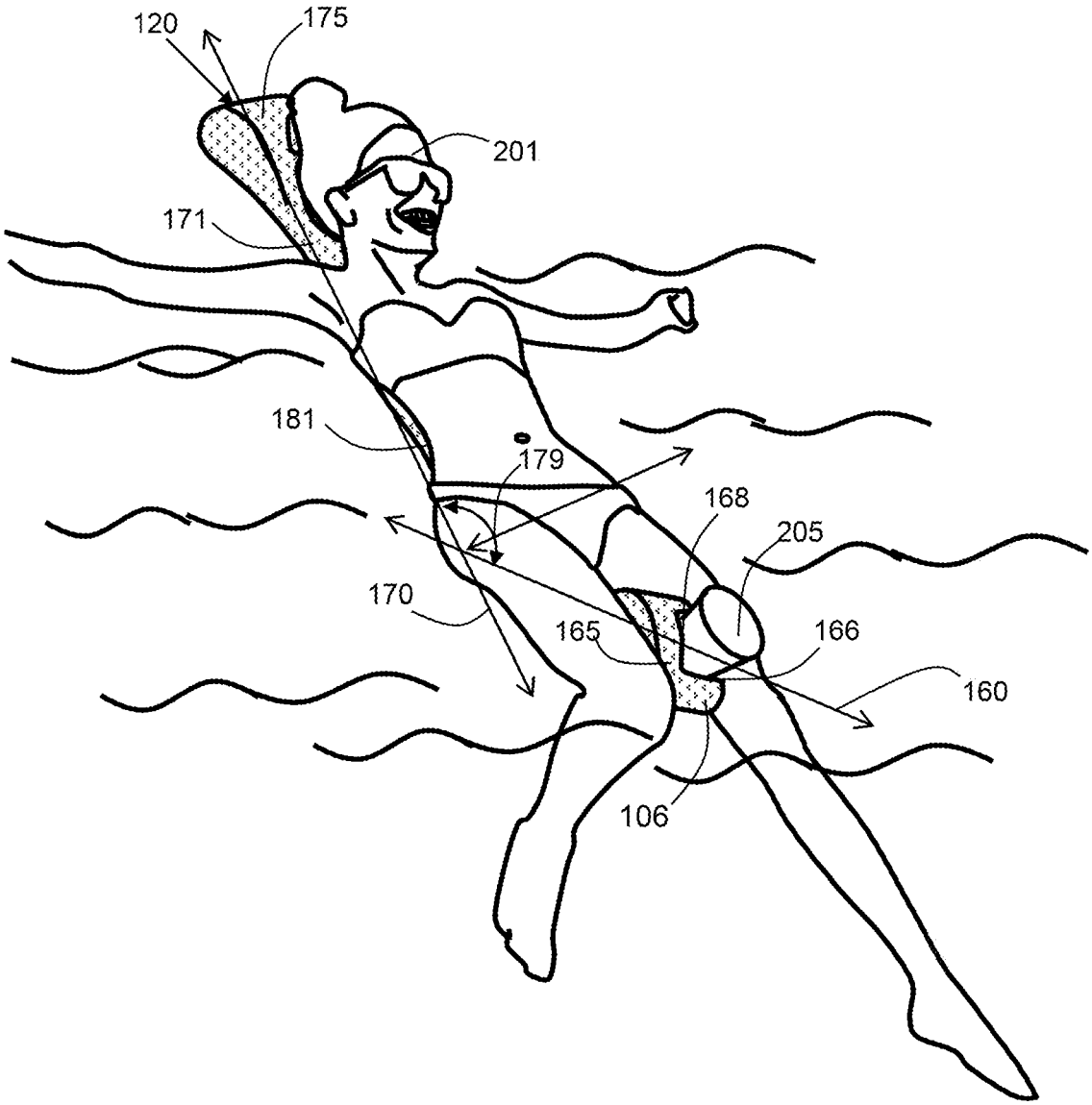
FIG. 13 shows an exemplary personal flotation device in use with a person floating in a back-floating configuration.

As shown in FIG. 13, an exemplary personal flotation device 120 is in use with a person 201 floating in a back-floating configuration. The back-floating configuration is similar to the hammock floating configuration except that the person is in a supine and fully reclined position and the personal flotation device is extended to a substantially linear configuration. The closed end 181 is substantially straightened or elongated to a substantially straight orientation, or within about 20 degrees of straight. The inclusive angle 179 between the right arm length axis 170 and the left arm length axis 160 is about 120 degrees or more or about 140 degrees or more, about 160 degrees or more, about 180 degrees or more and any range between and including the inclusive angles provided. Put another way, the right armrest length axis 170 extends at an offset from vertical, such as at least 60 degrees from vertical, to as much as 90 degrees from vertical or substantially horizontal. The personal flotation device is configured between the person's legs and extends through the crotch. The right armrest 171 extends along the person's back and the left armrest 161 extends from the crotch in front of the person. A beverage 205 is configured in the end cup holder 168 of the left arm bulb 165.

Figure 14:
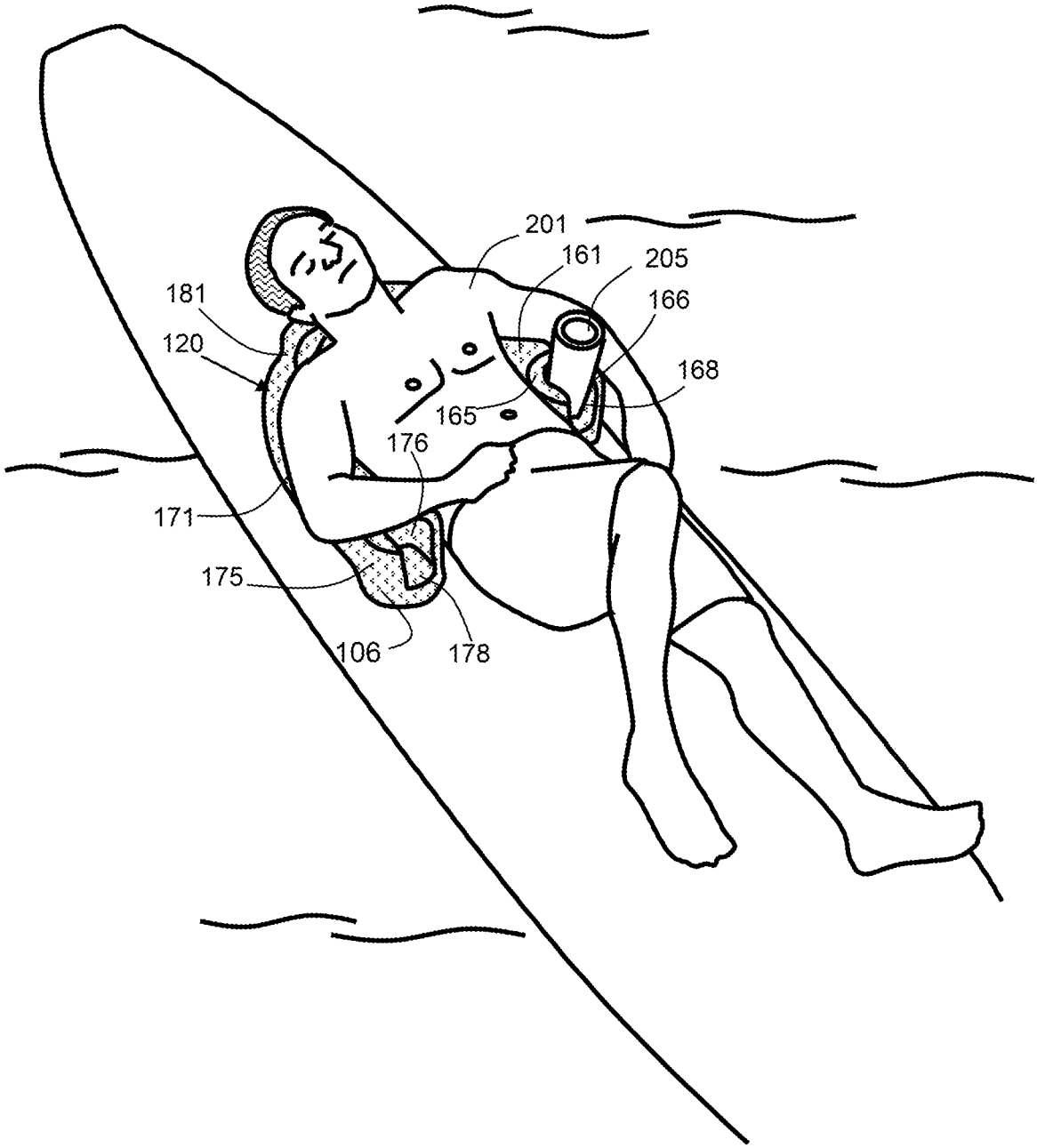
FIG. 14 shows an exemplary personal flotation device in use with a person resting in lounge-configuration.

As shown in FIG. 14, an exemplary personal flotation device 120 in use with a person 201 resting in lounge-configuration. The person is resting with their back in the open area between the left and right armrests and has their neck and/or head on the closed end. The person's arms are resting comfortably on the left and right armrests. A beverage 205 in retained in the left cup holder 166.

Figure 3:
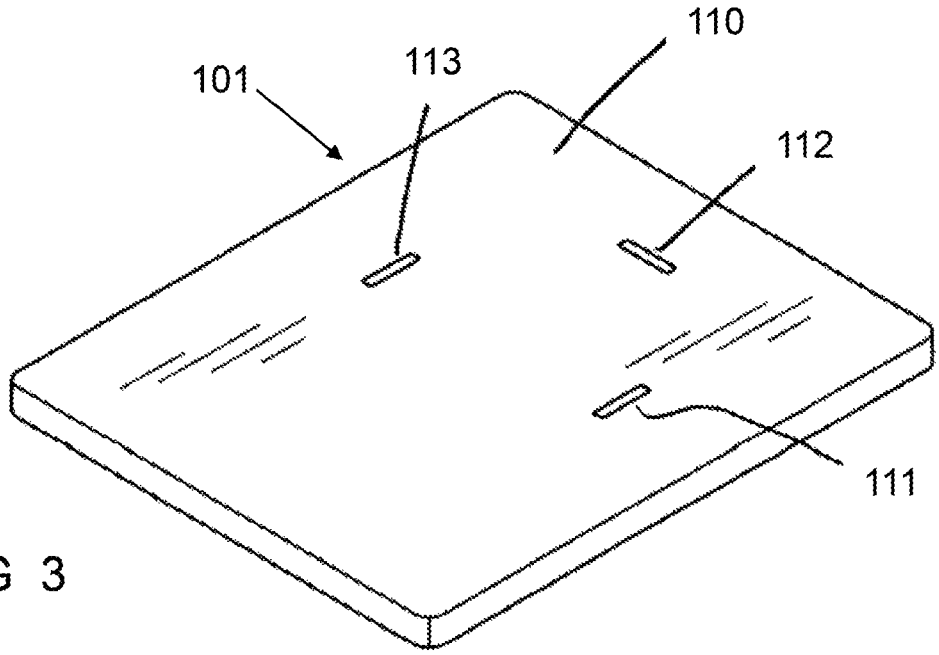
FIG. 3 is a perspective view of an embodiment of the disclosure.
Figure 4:
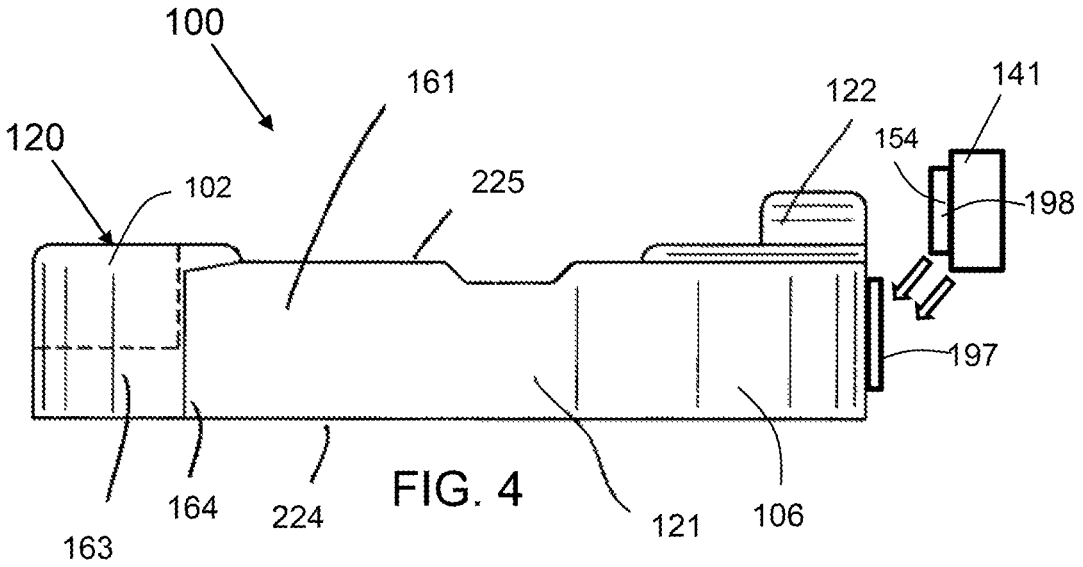
FIG. 4 is a side view of an embodiment of the disclosure.
Figure 5:
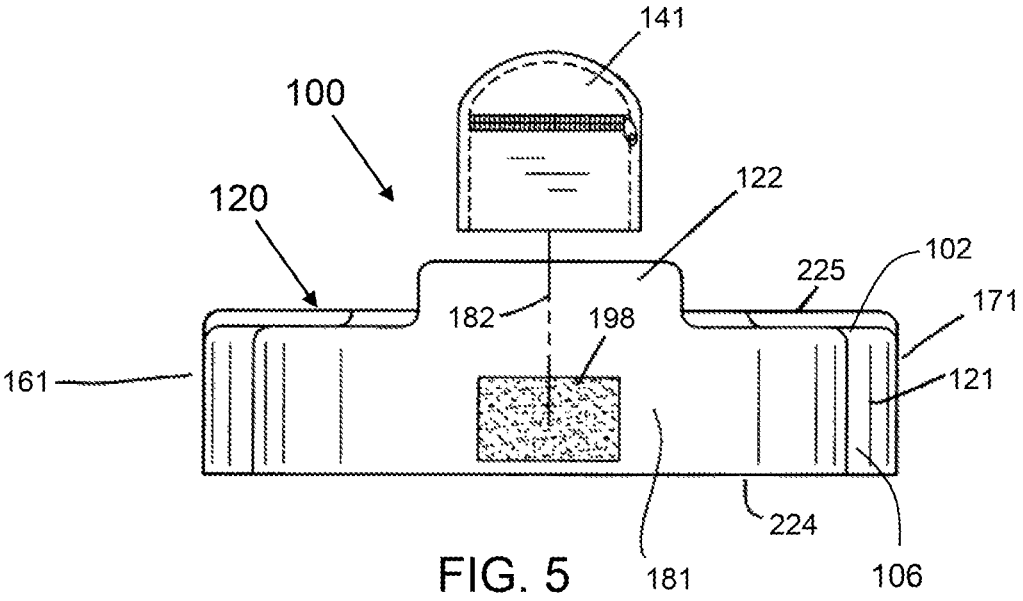
FIG. 5 is a side view of an embodiment of the disclosure.
Figure 15:
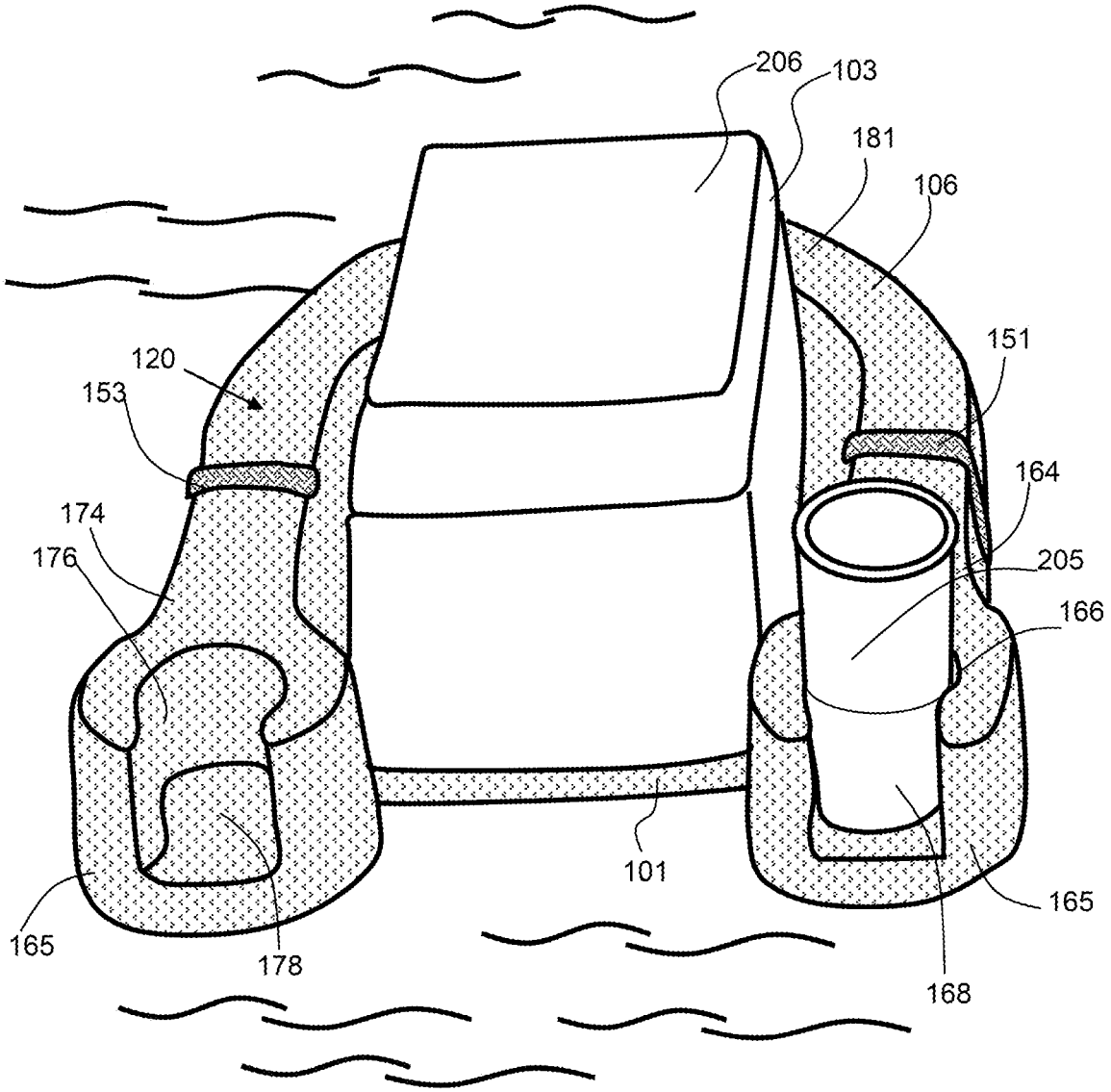
FIG. 15 shows an exemplary personal flotation device in use with a cooler floating in a gear-float configuration.

FIG. 15 shows an exemplary personal flotation device in use with a insulated storage case 103, or cooler 206, floating in a gear-float configuration. The cooler 206 is retained in the open area between the left armrest 161 and right armrest 171 and is secured on the pet pad 101. The pet pad is retained to the horseshoe shaped float 106 by the straps 151 and 153. As shown in FIG. 3, the straps extend down through the slots in the pet pad 101.

Figure 16:
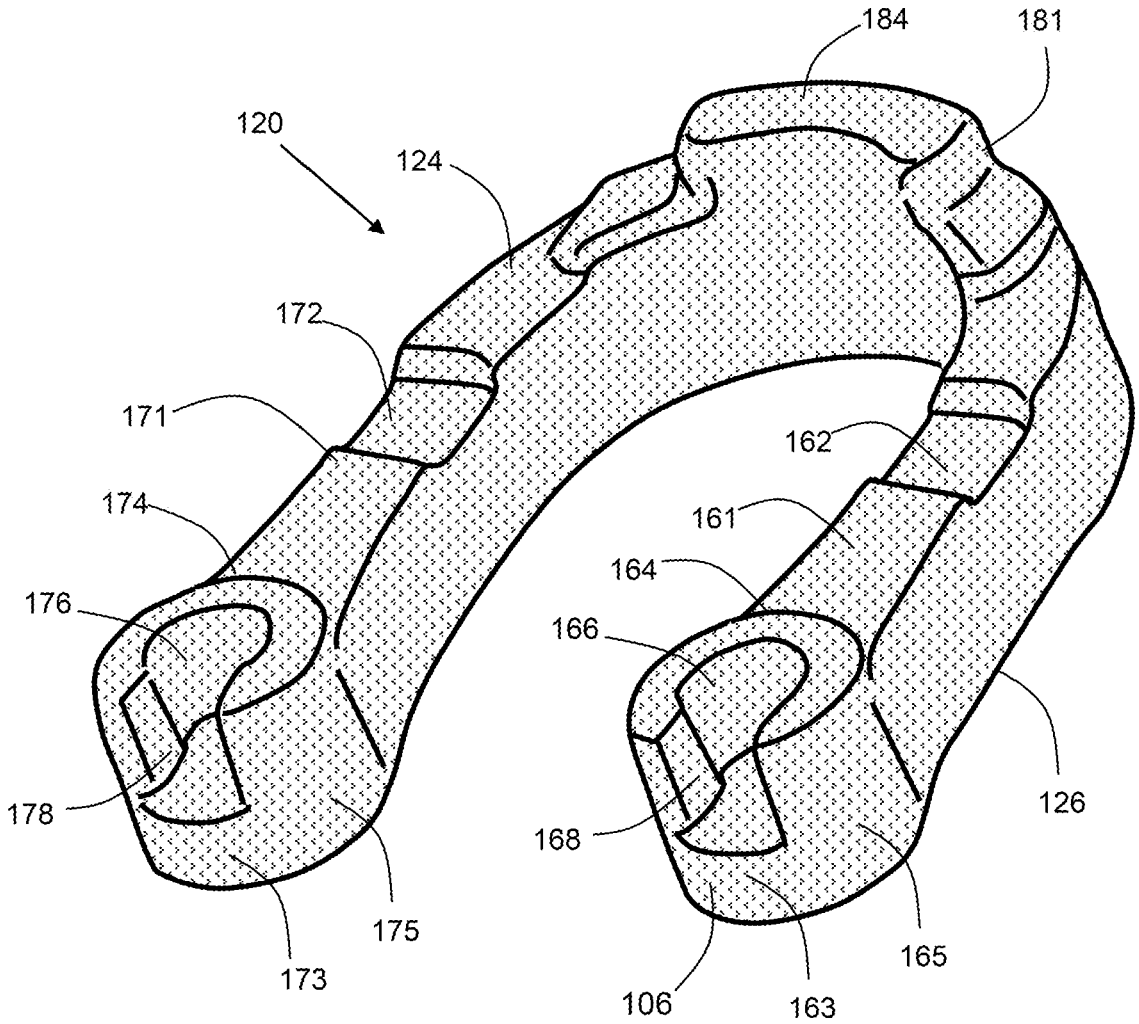
FIG. 16 shows a perspective view of an exemplary personal flotation device having a left and right arm bulb with an end cup holder.
Figure 17:
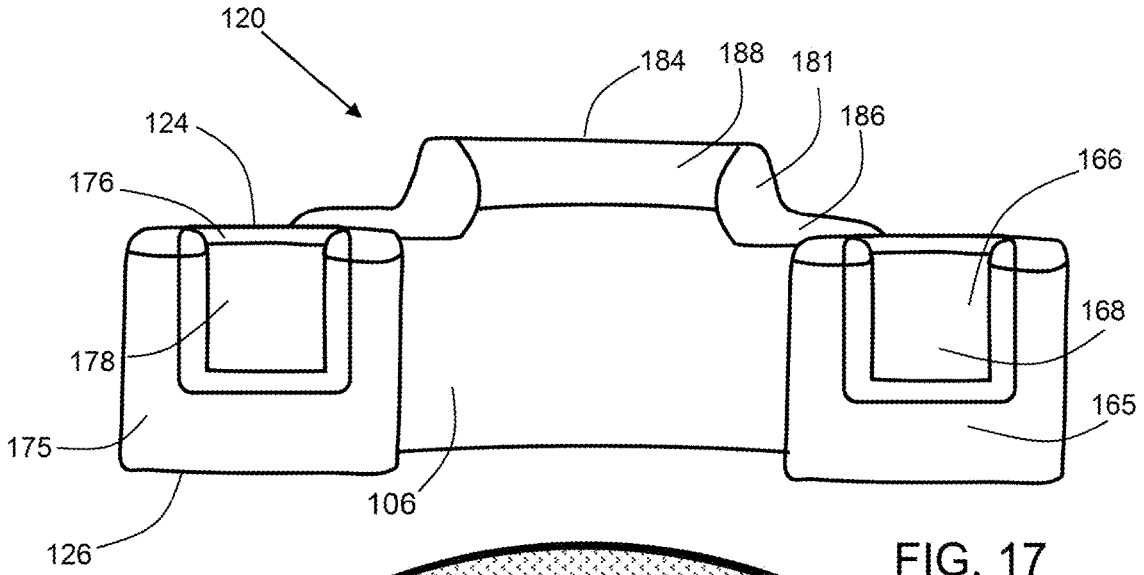
FIG. 17 shows a front view of an exemplary personal flotation device having a left and right arm bulb with an end cup holder.
Figure 18:
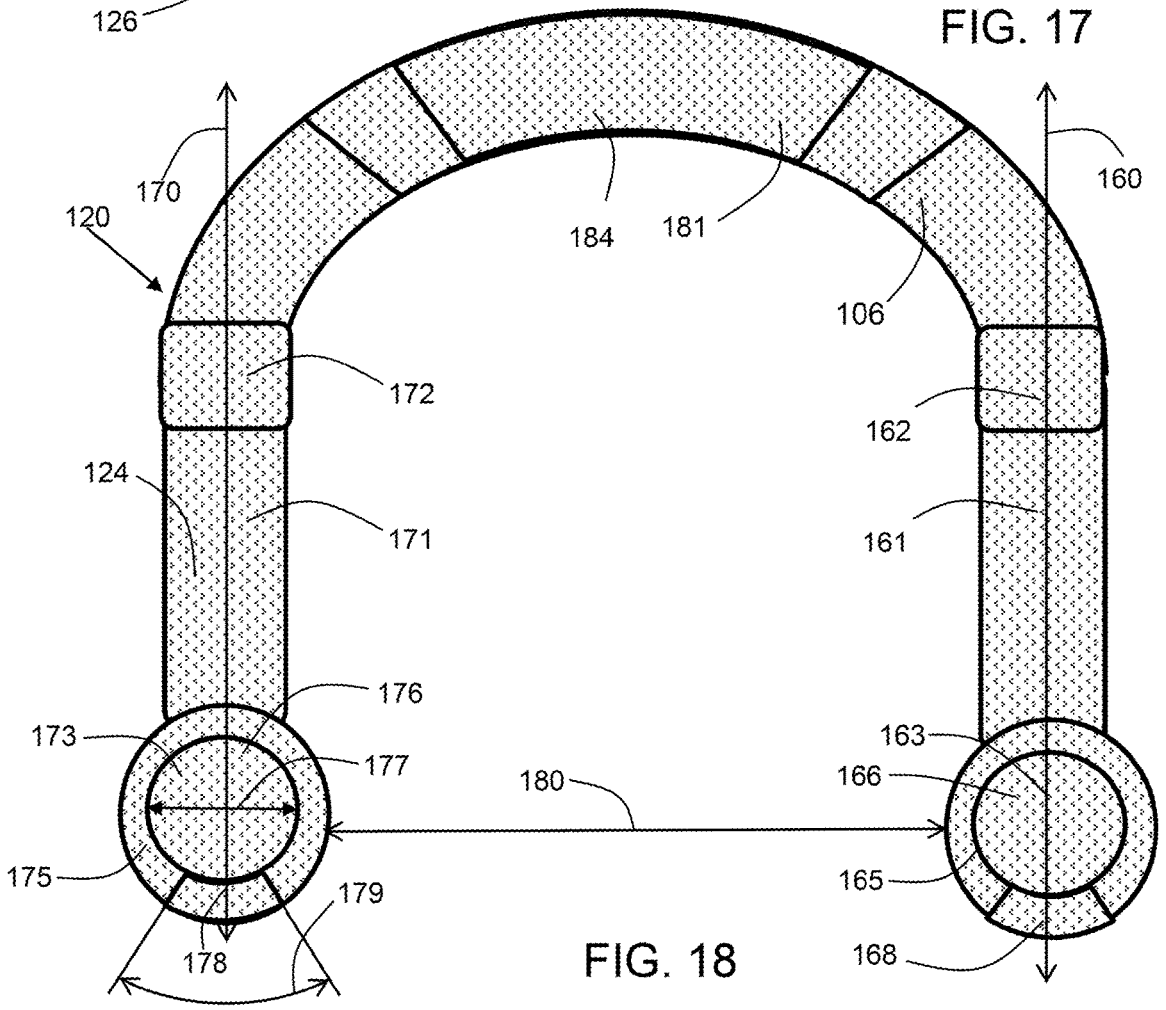
FIG. 18 shows a top view of an exemplary personal flotation having a left and right arm bulb with an end cup holder.
Figure 19:
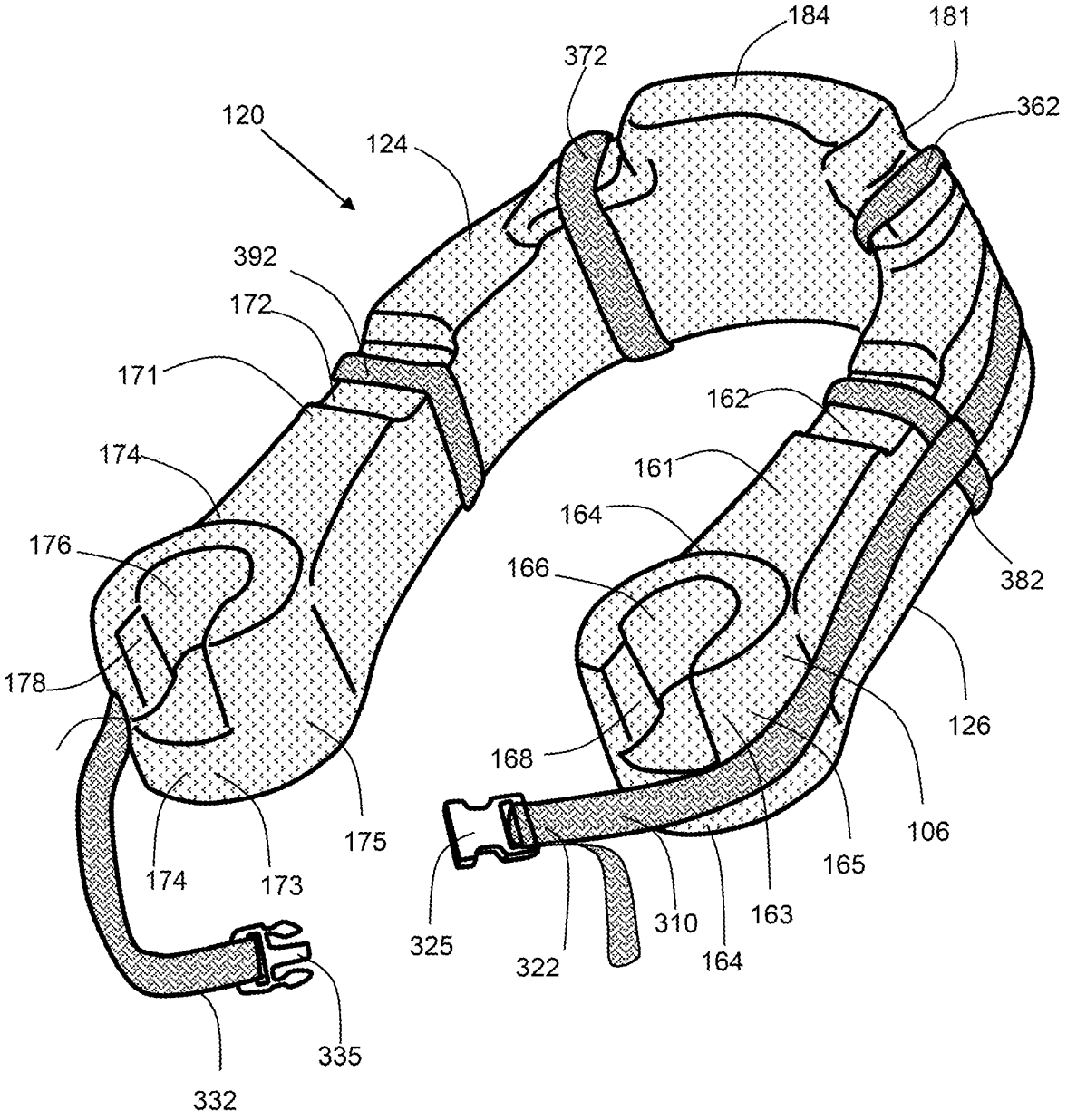
FIG. 19 shows a perspective view of an exemplary personal flotation device having a PFD strap system comprising a retaining strap that extends from the left armrest and right armrest, each having buckles to secure the PFD retaining strap together to secure the personal flotation device about a person's torso.

Referring now to FIGS. 16 to 18, an exemplary personal flotation device 120 has a left armrest 161 and right armrest 171 that extend from the closed end to produce a horseshoe shaped flotation device having an opening between the two extended ends of the left and right armrests, or between the two bulbs configured on the extended ends of the left and right armrest. The left and right armrests have grooves 162, 172, respectively to retain a strap. Each of the left and right arm bulbs 165, 175, respectively have a cup cylinder 166, 176 for receiving and retaining a beverage vertically, when the personal flotation device is used horizontally, as shown in FIGS. 10 and 14, and an end cup holder 168, 178, for receiving and retaining a beverage when the personal flotation device is used in an extended configuration, as shown in FIGS. 11 to 13. The exemplary personal flotation device also has a neck extension 184, that extends up vertically from the closed end, to provide support for a user's head. The personal flotation device has a top 124 and bottom 126. The bottom 126 is planar, or flat to allow the personal flotation device to rest securely on a flat surface, such as a paddle board, as shown in FIG. 14, or on the pet pad 101, as shown in FIG. 1.

As shown in FIG. 17, the horseshoe shaped personal flotation device is made of a foam 186 having a cover layer 188 that extends substantially over the entire outer surface, or at least 90% or more and preferably 95% or more of the outer surface area, and prevents water from entering into the cells of the foam, or has no bulk water flow therethrough, a liquid impermeable layer. The end cup holders 168 and 178 have an opening from the extended end of the bulb 165, 175, respectively, to the left and right cup cylinders 166, 176, respectively. The opening extends down a depth from the top of the personal flotation device but may also extend from the bottom surface or be an aperture having between the top and bottom surfaces. As shown in FIG. 17, the cup holders 163, 173 are dual cup holders, or cup holders that can retain a beverage in one of two different orientations that are substantially orthogonal to each other. A beverage can be retained in a vertical orientation or extending vertically in the cup cylinder or orthogonal to vertical, or horizontal or in plane with the top surface and within the end cup holder.

As shown in FIG. 18, the left and right bulbs each have a cup holder 163, 173 that are dual cup holders, or are configured to retain a beverage in orthogonal directions. The right cup cylinder 176 has a diameter 177, and the end cup holder 178 is an opening to the cup cylinder that extends an arc or radius 179. The diameter and radius may be about the same dimension and configured to hold a standard size beverage can, such as about 50 mm or more, about 75 mm or more, about 100 mm or more, about 75 to 125 mm and any range between and including the values provided. The opening may be smaller than an average beverage container and the resilient nature may enable the opening to expand to receive the beverage container. The left armrest length axis 160 and right armrest length axis 170 extend substantially parallel, or within about 20 degrees or parallel with each other, as shown in FIG. 18. When the left and/or right armrest are opened to expand the opening 180, between the left and right armrest, the length axes will extend at an angle from an intersection point with each other. This angle may be about 120 degrees when used in a hammock-float configuration and closer to 180 degrees when used in a back-float configuration.

Referring now to FIGS. 19 to 23, an exemplary personal flotation device 120 has a PFD strap system 300 comprising a PFD retaining strap 310 that has a left PFT extending strap 322 and a right PFD extending strap 332 having a buckles 325, 335 respectively, to secure the horseshoe shaped float 106 about a person. The strap can be buckled and tightened by pulling on the strap extending from the left PFD buckle 325 to synch the extended ends of the left armrest 161 and right armrest 171 tight about a person. The PFD retaining strap is secured to the horseshoe shaped float 106 by left groove over-strap 382 and right groove over-strap 392, that extend over and around the left groove 162 and right groove 172, of the left armrest 161 and right armrest 171, respectively. The PFD retaining strap is also secured to the horseshoe shaped float by left over-strap 362 and right over-strap 372 that extend over and around a portion of the closed end 181, or on opposing sides and proximal to the neck extension 184. Note that a single extending strap, such as the left extending strap 322 may extend over to the right arm and be detachably attached to a buckle coupled to the PFD strap system or to the PFD itself. For example, the buckle of the left extending strap may buckle to a buckle coupled to the right groove over-strap 392. Alternatively, the strap may detachably attach via hook-and-loop fastener material. The left extending strap may have hook-and-loop fastener proximal the end of the strap and it may be pulled tight and coupled with hook-and-loop fastener on the horseshoe shaped float 106, or to the PFD strap system, such as to the right extending strap.

Figure 20:
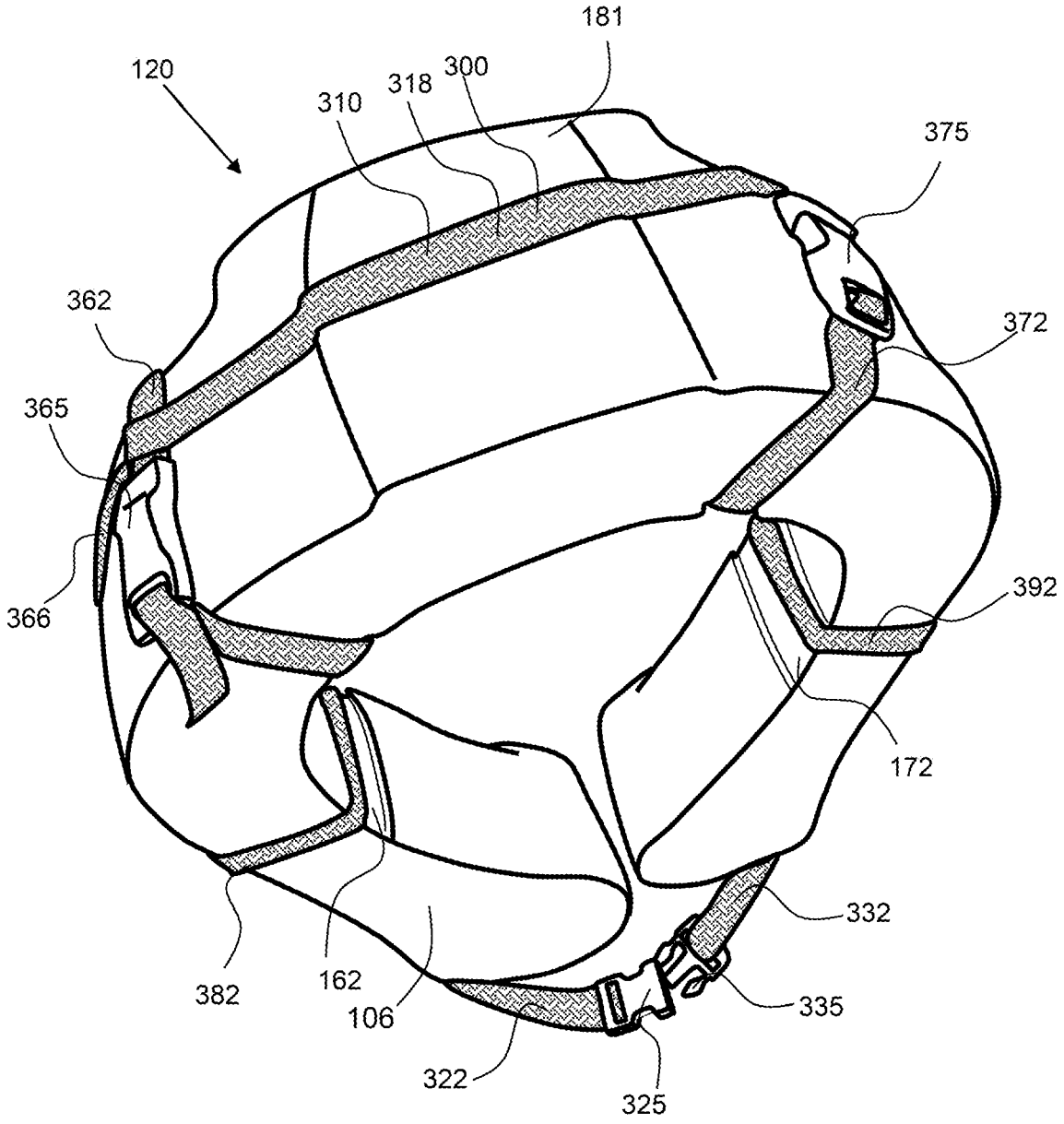
FIG. 20 shows a back perspective view of the exemplary personal flotation device shown in FIG. 20 and the back extension of the retaining strap extending between left and right over-straps and left and right over-straps extending around the left and right armrest in the left and right grooves, respectively.

As shown in FIG. 20, the left over-strap 362 and right over-strap 372 have a left over-strap buckle 365 and right over-strap buckle 375, respectively. Likewise, the left groove over-strap 382 and right groove over-strap 392 may have buckles to enable the PFD strap system 300 to be removed from the horseshoe shaped float 106. A back extension strap 318, which is part of the PFD retaining strap 310, is shown in FIG. 20.

Figure 21:
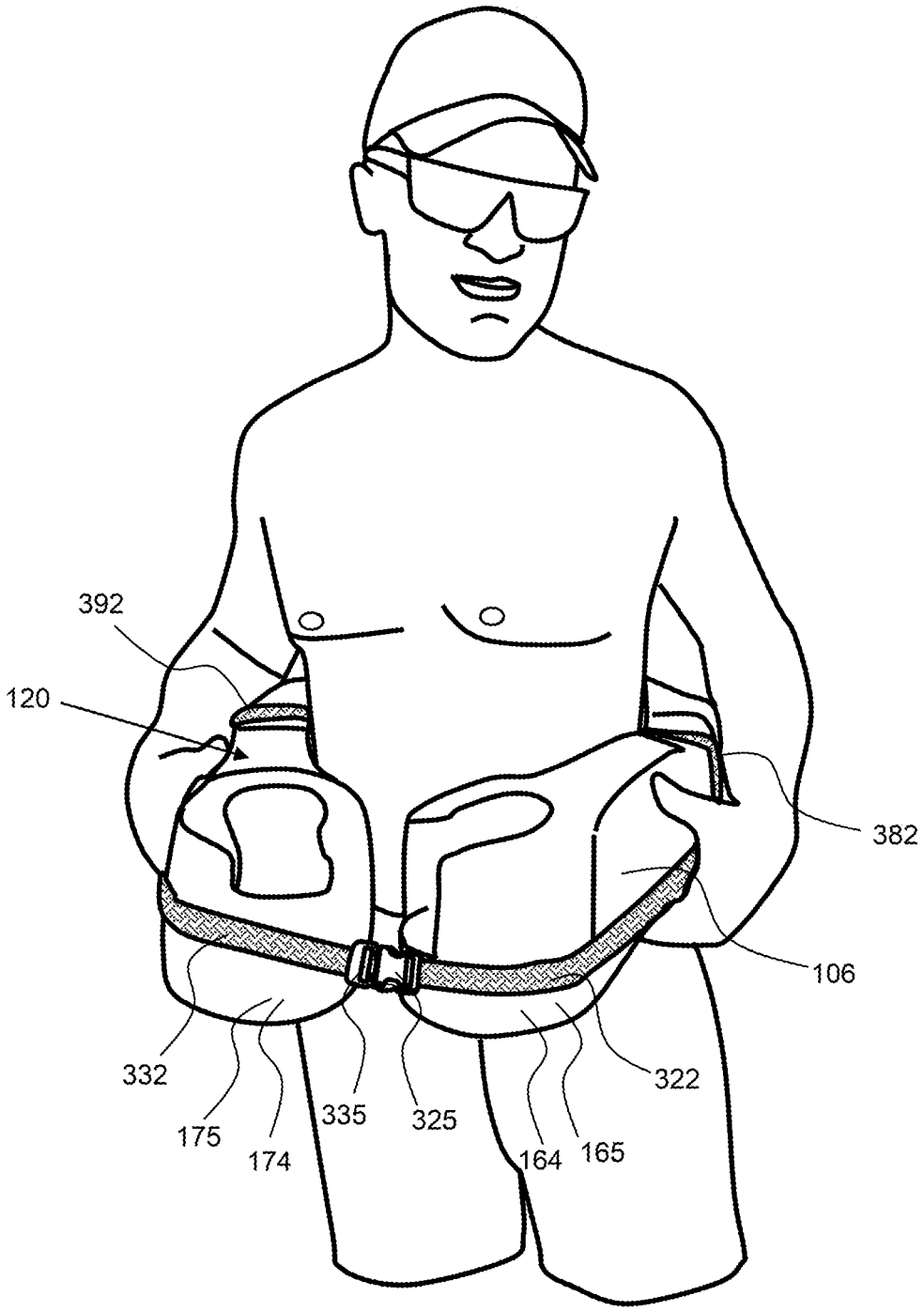
FIG. 21 shows a perspective view of an exemplary personal flotation device being secured around a man's torso by the PFD strap system.

As shown in FIG. 21, the exemplary personal flotation device 120 has the PFD strap system 300 buckled by the left PFD buckle 325 and right PFD buckle 335. The left arm bulb 165 and right arm bulb 175 are pulled together by the strap to secure the personal flotation device about the person's torso.

Figure 22:
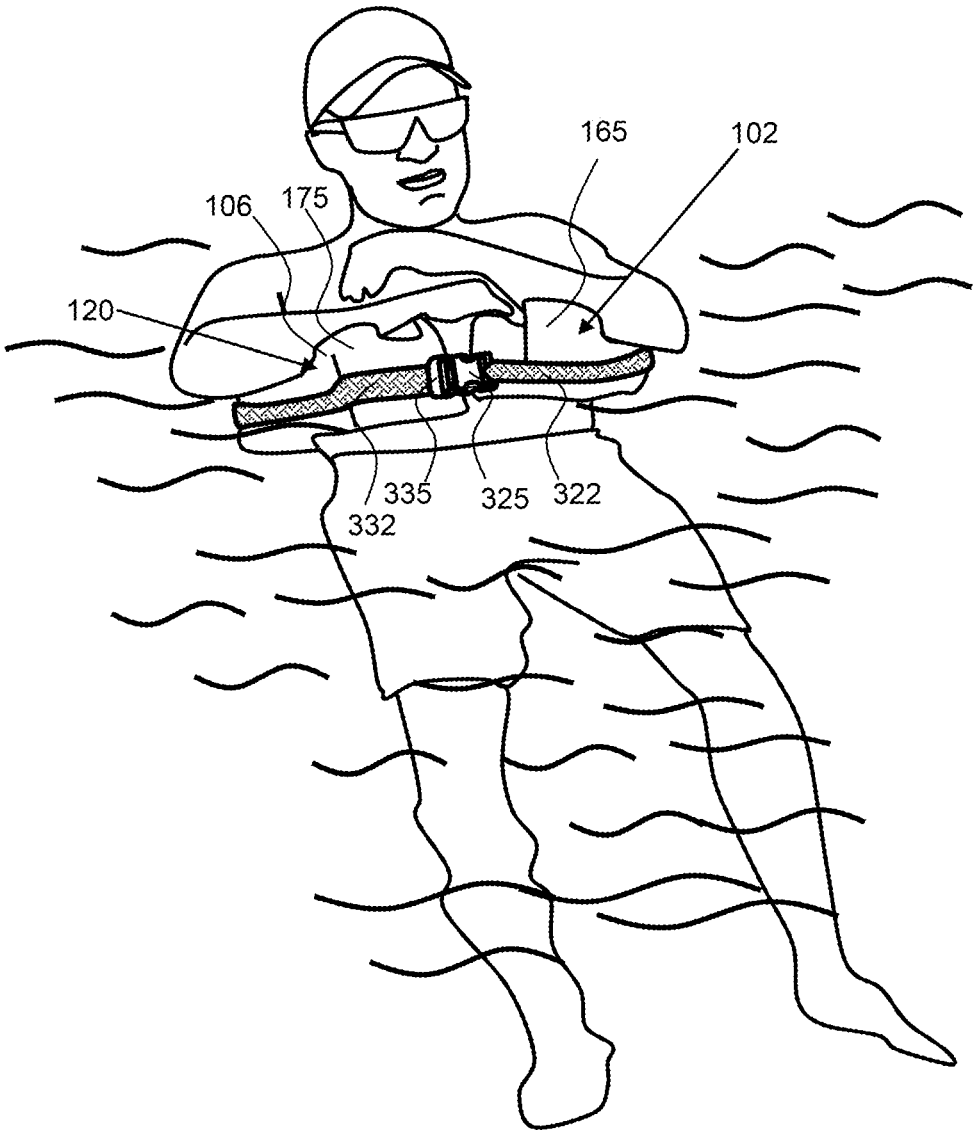
FIG. 22 shows a perspective view of an exemplary personal flotation device secured around a man's torso by the PFD strap system and securely keeping the man afloat in the water.

As shown in FIG. 22, the person is being securely supported in the water by the personal flotation device 120 having the PFD retaining strap 310 secured about the horseshoe shaped float 106.

Figure 23:
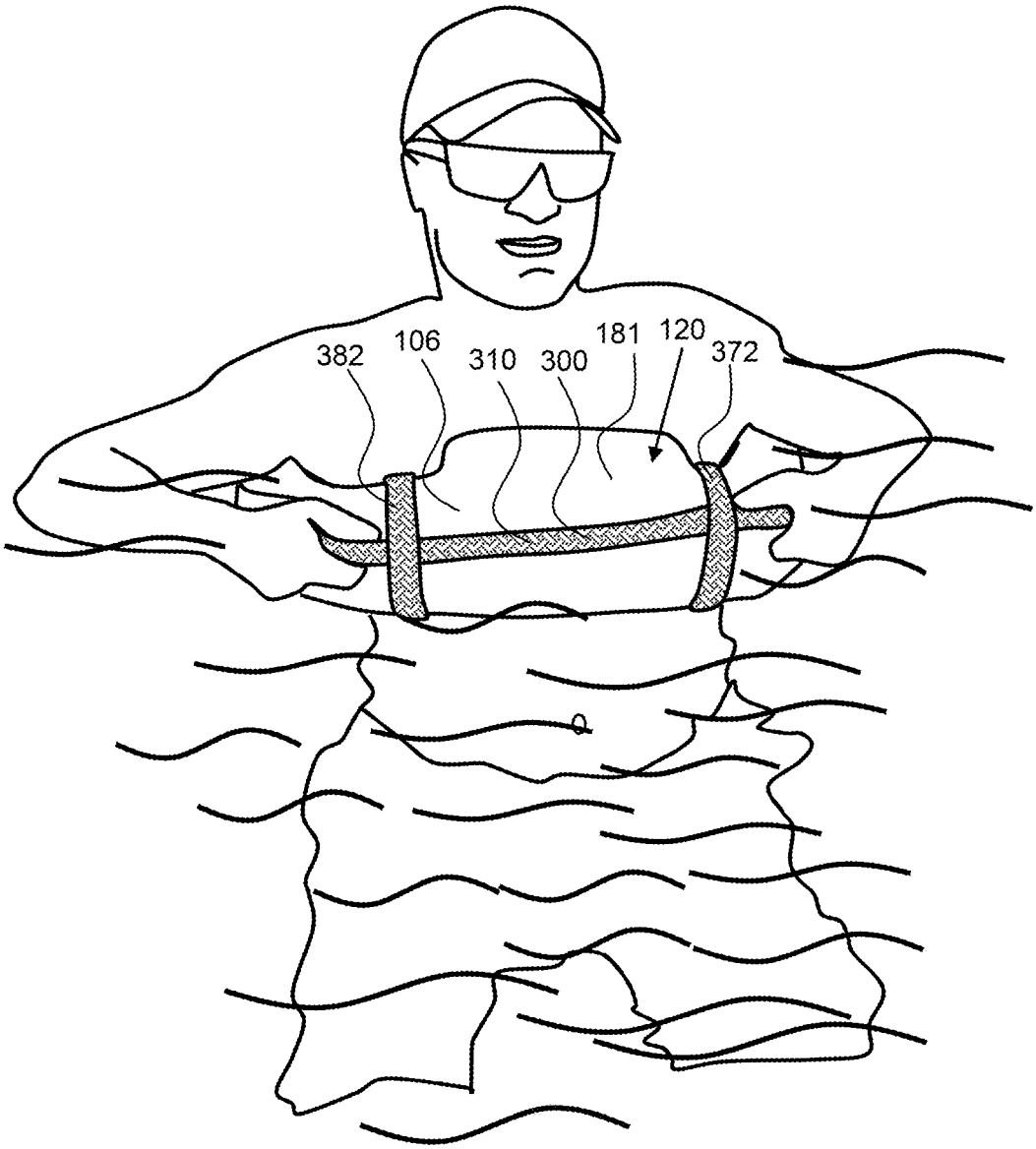
FIG. 23 shows a perspective view of an exemplary personal flotation device secured around a man's torso by the PFD strap system and securely keeping the man afloat in the water.

As shown in FIG. 23, the person is being securely supported in the water by the personal flotation device 120 and is facing the closed end 181 or the horseshoe shaped float 106.

The following definitions are used in this disclosure:

Anchor: As used in this disclosure, anchor means to hold an object firmly or securely.

Anchor Point: As used in this disclosure, an anchor point is a location to which a first object can be securely attached to a second object.

Bind: As used in this disclosure, to bind is a verb that means to tie or secure a first object to a second object by wrapping a third object around the first object and the second object.

Bungee: As used in this disclosure, the term bungee refers to an elastic cord or a mesh of elastic cords.

Channel: As used in this disclosure, a channel is a tubular passage through which an object or fluid is passed through.

Coaxial: As used in this disclosure, coaxial is a term that refers to a first object that is inserted or contained within a second object such: 1) that the first object and the second object share the same center point if the or first object and the second object are treated as a two dimensional objects; or, 2) that the first object and the second object share the same center axis if the first object and the second object are treated as a cylinder.

Congruent: As used in this disclosure, congruent is a term that compares a first object to a second object. Specifically, two objects are said to be congruent when: 1) they are geometrically similar; and, 2) the first object can be superimposed over the second object such that the first object aligns, within manufacturing tolerances, with second object.

Copolymer: As used in this disclosure, a copolymer is a polymer formed from two or more repeating molecules, also referred to as monomers.

Cord: As used in this disclosure, a cord is a long, thin, and flexible piece of string, line, rope, or wire. Cords are made from yarns, piles, or strands of material that are braided or twisted together or from a monofilament, such as fishing line. Cords have tensile strength but are too flexible to provide compressive strength and are not suitable for use in pushing objects. String, line, cable, and rope are synonyms for cord.

Correspond: As used in this disclosure, the term correspond means that a first object is in some manner linked to a second object in a one to one relationship.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its relaxed shape after the force is removed. A material that exhibits these qualities is also referred to as an elastomeric material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed.

Shock cord and bungee cord are synonyms for an elastic cord.

Ethylene-Vinyl Acetate: As used in this disclosure ethylene-vinyl acetate (CAS 24938-78-8—also referred to as polyethylene-vinyl acetate) is a copolymer formed from ethylene and vinyl acetate molecules.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, buttons, buckles, quick release buckles, or hook-and-loop fasteners.

Flush: As used in this disclosure, the term flush is used to describe the alignment of a first surface and a second surface on a single plane.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal.

Grip: As used in this disclosure, a grip is an accommodation formed on or within an object that allows the object to be grasped or manipulated by a hand.

Hinge: As used in this disclosure, a hinge is a device that permits the turning, rotating, or pivoting of a first object relative to a second object.

Hook-and-loop Fastener: As used in this disclosure, a hook-and-loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook-and-loop fastener will be placed on the first object and the matching loop surface of a hook-and-loop fastener will be placed on the second object without significant regard to which object of the two objects is the first object and which of the two objects is the second object. When the hook surface of a hook-and-loop fastener or the loop surface of a hook-and-loop fastener is attached to an object this will simply be referred to as the "hook/loop surface" with the understanding that when the two objects are fastened together one of the two objects will have a hook surface and the remaining object will have the loop surface.

Horseshoe: As used in this disclosure, a horseshoe refers to an object that has the shape of a horseshoe. The horseshoe refers to a metal structure that is used to protect the hoof of a horse. Specifically, the metal structure is a metal band that is attached around the perimeter of the bottom of the hoof of the horse. The horseshoe has an appearance of open U-shaped ring having a curved closed end and two extension that extend out from the closed end in the same direction.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Lid: As used in this disclosure, a lid is a removable cover that is placed over an opening of a hollow structure to enclose the hollow structure.

Loop: As used in this disclosure, a loop is a length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

PFD: As used in this disclosure, PFD is an acronym for a personal flotation device. A personal flotation device is safety equipment in the form of a garment or device that assists a person in remaining afloat in water.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk like appearance.

Rectilinear Block: As used in this disclosure, a rectilinear block refers to a three-dimensional structure comprising a plurality of rectangular surfaces. Rectilinear blocks are similar to rectangular blocks and are often used to create a structure with a reduced interior volume relative to a rectangular block. Within this disclosure, a rectilinear block may further comprise rounded edges and corners.

Rounded: A used in this disclosure, the term rounded refers to the replacement of an apex, vertex, or edge or brink of a structure with a generally smooth curvature wherein the concave portion of the curvature faces the interior or center of the structure.

Cylindrical shaped as used to describe the right or left arm bulb includes curved outer and/or inner surfaces of the bulb, such as those that are configured to retainer a cylindrical shaped beverage container, such as a can, bottle, cup and the like. The outer shape may be curved around the cylindrical shaped cup holder to produce a substantially uniform thickness ring or cylinder. Note that the cylinder may be incomplete as and end cup holder may produce an opening to the cup holder.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Slot: As used in this disclosure, a slot is a long narrow groove or aperture that is formed in an object.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

With respect to the above description, it is to be realized that the optimum dimensional relationship for the various components of the personal flotation system described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the personal flotation system.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A personal flotation system comprising:

a) a horseshoe shaped personal flotation device that is buoyant and comprises:

i) a closed end;

ii) a right armrest extending from a first side of the closed end to a right armrest free end;

iii) a cylindrical shaped right arm bulb configured on the right armrest free end;

iv) a left armrest extending from a second side of the closed end to a left arm free end;

v) a cylindrical shaped left arm bulb configured on the left armrest free end;

vi) a cup cylinder configured in at least one of the left arm bulb or right arm bulb and having an opening extending into said armrest bulb from a top surface of said left arm bulb or right arm bulb;

vii) an end cup holder configured in at least one of the left arm bulb or right arm bulb and having an opening extending into said armrest bulb from the free end;

viii) an inner perimeter extending along the closed end and along the left armrest and right armrest; and wherein the closed end extends in an arc from the right armrest to the left armrest;

b) a personal floatation device strap system comprising:

i) a personal floatation device extending strap that extends around the free end of the left armrest or the right armrest;

wherein the personal floatation device extending strap is configured to extend to and be secured to the opposing left arm or right arm rest to couple the left armrest to the right armrest by said personal floatation device extending strap.

2. The personal flotation system of claim 1, wherein the personal floatation device comprises hook-and-loop fastener on the left or right armrest and wherein the extending strap extends from an opposing armrest from said left or right armrest, and wherein the personal floatation device extending strap comprises hook-and-loop fastener configured to be detachably attached to said hook-and-loop fastener on said left or right armrest.

3. The personal flotation system of claim 1, wherein the personal floatation device strap system comprises:

i) a left extending strap that extends around the free end of the left armrest and comprises hook-and-loop fastener; and ii) a right extending strap that extends around the free end of the right armrest and comprises hook-and-loop fastener;

wherein the left extending strap and the right extending strap are configured to be secured to each by said hook-and-loop fasteners to couple the left arm to the right arm.

4. The personal flotation system of claim 1, wherein the personal floatation device extending strap comprises a buckle configured to be secured to a buckle coupled to the opposing left arm or right arm rest.

5. The personal flotation system of claim 1, wherein the personal floatation device strap system comprises:

i) a left extending strap that extends around the free end of the left armrest; and ii) a right extending strap that extends around the free end of the right armrest;

wherein the left extending strap and the right extending strap are configured to be secured to each other to couple the left arm to the right arm.

6. The personal flotation system of claim 4, wherein the left extending strap comprises a buckle, and wherein the right extending strap comprises a buckle, wherein the buckle of the left extending strap is configured to be buckled with the buckle of the right extending strap.

7. The personal flotation system of claim 1, wherein the personal floatation device strap system further comprises an over-strap extending around the horseshoe shaped personal floatation device that secures the extending strap to the personal floatation device.

8. The personal flotation system of claim 7, wherein comprising two over-straps.

9. The personal flotation system of claim 8, wherein a first over-strap of the two over-strap is configured around the left armrest and wherein a second over-strap of the two over-straps is configured around the right armrest.

10. The personal flotation system of claim 9, wherein the personal flotation device further comprises:

i) a right armrest groove extending down from a top surface of the right armrest and substantially orthogonal to an extension direction of the right armrest;

ii) a left armrest groove extending down from a top surface of the left armrest and substantially orthogonal to an extension direction of the left armrest.

11. The personal flotation system of claim 10, wherein the first over-strap is extends around the left armrest in the left armrest groove and wherein the second over-strap extends around the right armrest in the right armrest groove.

12. The personal flotation system of claim 1, further comprising a neck extension that extends up from closed end.

13. The personal flotation system of claim 12, wherein the personal floatation device strap system further comprises two over-straps wherein a first over-strap of the two over-straps is configured on a left side of the neck extension and wherein a second over-strap of the two over-straps is configured on a right side of the neck extension.

14. The personal flotation system of claim 1, further comprising a dry storage case comprising:

a) a dry bag;

b) a hook/loop fastener coupled to an outside surface of the dry bag;

wherein the personal float comprises a hook/loop fastener coupled to an outside surface for attachment of the dry bag by said hook/loop fastener coupled to the dry bag.

15. The personal flotation system of claim 1, further comprising:

c) a pet pad that is detachably attachable to the personal flotation device and configured under the personal flotation device along a bottom surface of the personal flotation device, and wherein the pet pad comprises:

a substantially planar buoyant structure;

a left side slot; and right side slot, d) a groove over-strap; and wherein the personal flotation device further comprises:

i) a right armrest groove extending down from a top surface of the right armrest and substantially orthogonal to an extension direction of the right armrest;

ii) a left armrest groove extending down from a top surface of the left armrest and substantially orthogonal to an extension direction of the left armrest;

wherein the right and left armrest grooves are aligned at a distance from the closed end; and wherein the pet pad is configured for detachable attachment to the personal flotation device with said groove over-strap extended through said left side slot and around the left armrest along the left armrest grooves, under the ped pad to extended through said right side slot and around the right armrest along the right armrest groove to attach the pet pad to the personal flotation device.

16. The personal flotation system of claim 15, wherein the left side slot and right side slot are configured inward the inner perimeter of the personal flotation device and aligned with the left armrest and right armrest respectively, and wherein the strap extends over the left armrest groove and the right armrest groove, and wherein the left and right armrest grooves retain the strap in position on the left and right armrest respectively.

17. The personal flotation system of claim 16, wherein the pet pad further comprises a third slot configured substantially orthogonal to said left side and right side slots and configured to receive an second strap therethrough said slot and around the closed end of the personal flotation device.

18. The personal flotation system of claim 1, wherein the personal flotation device further comprises an insulated storage case that is detachably attachable to the personal flotation device and wherein the insulated storage case comprises:

a) a storage area;

b) a lid over said storage area;

c) an outer perimeter;

d) a handle slot configured to align with the third slot in the pet pad wherein the outer perimeter of the insulated storage case fits within the inner perimeter of the personal flotation device.

19. The personal flotation system of claim 18, wherein the personal flotation device further comprising a dry storage case comprising:

a) a dry bag;

b) a hook/loop fastener coupled to an outside surface of the dry bag;

wherein the personal float comprises a hook/loop fastener coupled to an outside surface for attachment of the dry bag by said hook/loop fastener coupled to the dry bag.

20. The personal flotation system of claim 17, wherein the personal flotation device further comprising a dry storage case comprising:

a) a dry bag;

b) a hook/loop fastener coupled to an outside surface of the dry bag;

wherein the personal float comprises a hook/loop fastener coupled to an outside surface for attachment of the dry bag by said hook/loop fastener coupled to the dry bag.

* * * * *